US010252831B2

(12) United States Patent
Kenner et al.

(10) Patent No.: US 10,252,831 B2
(45) **Date of Patent: *Apr. 9, 2019**

(54) TRAY COVER, TRAY INSERT, AND METHODS THEREOF

(71) Applicant: Multi Packaging Solutions, Inc., Lansing, MI (US)

(72) Inventors: Ralf Kenner, Bietigheim (DE); Lucien Wende, Mosbach (DE)

(73) Assignee: MULTI PACKAGING SOLUTIONS, INC., Lansing, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/926,320

(22) Filed: Mar. 20, 2018

(65) Prior Publication Data

US 2018/0208351 A1 Jul. 26, 2018

Related U.S. Application Data

(60) Division of application No. 14/803,527, filed on Jul. 20, 2015, now Pat. No. 9,957,079, which is a (Continued)

(30) Foreign Application Priority Data

Apr. 13, 2012 (EP) ..... 12164150

(51) Int. Cl.
*B65D 5/42* (2006.01)
*B65D 5/02* (2006.01)
(Continued)

(52) U.S. Cl.
CPC ..... *B65D 5/0254* (2013.01); *B65D 5/4266* (2013.01); *B65D 5/445* (2013.01);
(Continued)

(58) Field of Classification Search
CPC ..... B65D 5/0254; B65D 5/60; B65D 5/62; B65D 5/4266; B65D 5/445; B65D 25/02; B65D 25/34
(Continued)

(56) References Cited

U.S. PATENT DOCUMENTS 1,925,113 A * 9/1933 Rutledge ..... B65D 5/326 229/104
2,064,488 A 12/1936 Rodgers
(Continued)

FOREIGN PATENT DOCUMENTS

DE 92 02 098 U1 8/1992
EP 2072408 A1 6/2009
(Continued)

OTHER PUBLICATIONS

PCT International Preliminary Report on Patentability dated Jul. 17, 2014; Application No. PCT/US2013/030671.
(Continued)

*Primary Examiner* — Luan K Bui
(74) *Attorney, Agent, or Firm* — The Dobrusin Law Firm, P.C.

(57) ABSTRACT

The present teachings are direct at tray, components in a tray, methods for assembling trays, and articles, such as boxes that include a tray. The covers and/or tray inserts include one or more features that result in one or more of the following benefits: improved performance during or after assembly of a tray, improved ease of assembling a tray, or improved appearance of a tray, or any combination thereof. The features can be used alone. However, a number of the features when combined, result in particularly robust assembly processes.

17 Claims, 20 Drawing Sheets

Related U.S. Application Data continuation of application No. 13/448,681, filed on Apr. 17, 2012, now Pat. No. 9,120,592.

(51) Int. Cl.

| | |
|---|---|
| ***B65D 25/02*** | (2006.01) |
| ***B65D 25/34*** | (2006.01) |
| ***B65D 5/44*** | (2006.01) |
| ***B65D 5/60*** | (2006.01) |
| ***B65D 5/62*** | (2006.01) |

(52) U.S. Cl.

CPC ..... *B65D 5/60* (2013.01); *B65D 5/62* (2013.01); *B65D 25/02* (2013.01); *B65D 25/34* (2013.01)

(58) Field of Classification Search

USPC ..... 206/459.5, 557; 229/117.01, 117.07, 229/117.08, 122.32, 122.34, 163, 229/165–167, 172–174, 178, 186, 195, 229/197, 199

See application file for complete search history.

(56) References Cited

U.S. PATENT DOCUMENTS

| | | | | |
|---|---|---|---|---|
| 3,286,900 | A | 11/1966 | Keith | |
| 5,383,595 | A | 1/1995 | Hallam | |
| 5,586,717 | A | 12/1996 | Hallam | |
| 6,012,631 | A | 1/2000 | Hallam | |
| 7,044,359 | B1 | 5/2006 | Cohen | |
| 2004/0011860 | A1* | 1/2004 | Lebras | B65D 5/2009 229/122.27 |
| 2006/0163334 | A1 | 7/2006 | Kay | |
| 2006/0202007 | A1 | 9/2006 | Cohen | |
| 2007/0000983 | A1 | 1/2007 | Spurrell | |
| 2008/0223911 | A1 | 9/2008 | Mazurek | |
| 2010/0294831 | A1 | 11/2010 | Hallam | |
| 2011/0155797 | A1* | 6/2011 | Hallam | B65D 5/22 229/122.32 |
| 2011/0200768 | A1 | 8/2011 | Revell et al. | |

FOREIGN PATENT DOCUMENTS

| | | | |
|---|---|---|---|
| EP | 2185431 | A1 | 5/2010 |
| EP | 2262692 | A2 | 12/2010 |
| GB | 2475019 | A | 5/2011 |
| WO | 2007/127742 | A2 | 11/2007 |
| WO | 2009/013542 | A1 | 1/2009 |
| WO | 2009/109783 | A3 | 9/2009 |
| WO | 2010/020815 | A2 | 2/2010 |
| WO | 2010/131040 | A1 | 11/2010 |

OTHER PUBLICATIONS

Canadian Office Action dated Apr. 9, 2014; Appln. No. 2,800,628.

European Search Report for Corresponding European Patent Application No. 12 16 4150 filed Apr. 13, 2012, dated Oct. 1, 2012.

Office Action from the European Patent Office, Application No. 12164150.0 dated Jun. 11, 2015.

* cited by examiner

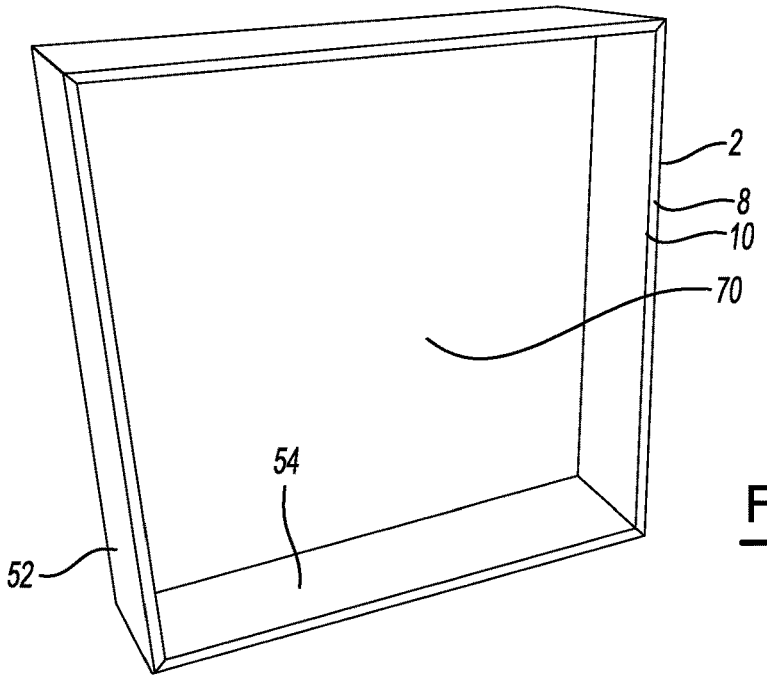
Fig - 12
Fig - 13
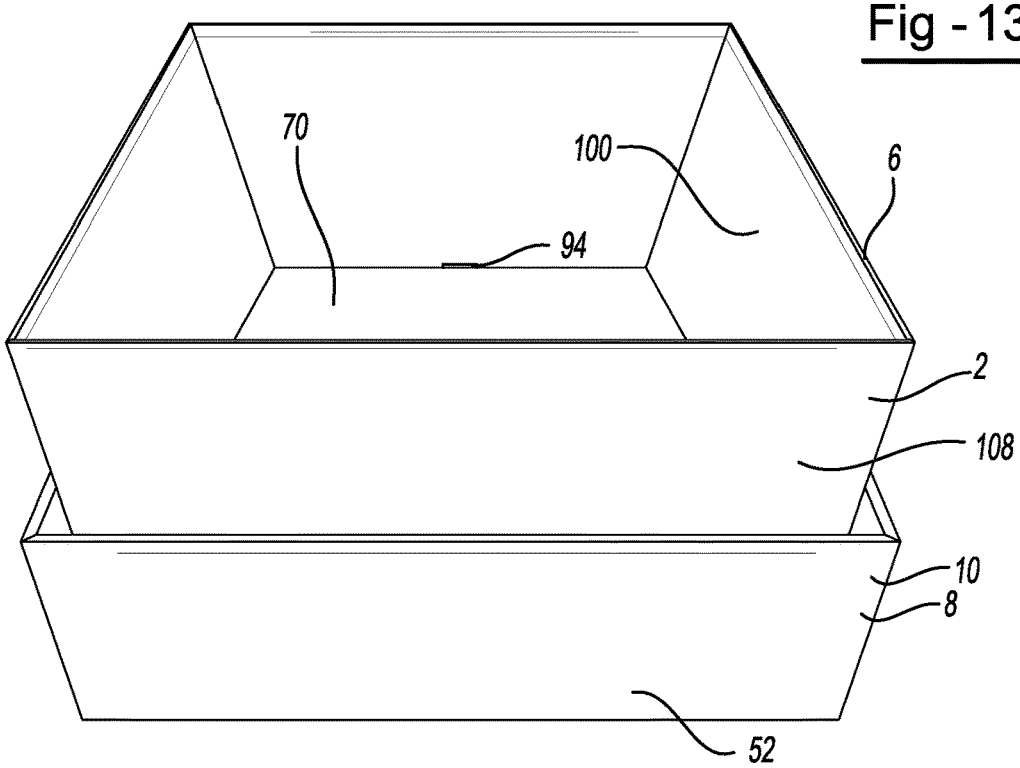

TRAY COVER, TRAY INSERT, AND METHODS THEREOF

CLAIM OF PRIORITY

The present application is a divisional patent application of U.S. patent application Ser. No. 14/803,527 filed on Jul. 20, 2015, which is a continuation of U.S. patent application Ser. No. 13/448,681 filed on Apr. 17, 2012, and claims the benefit of the filing date of EP Patent Application 12164150.0, filed Apr. 13, 2012. The contents of U.S. patent application Ser. Nos. 14/803,527 and 13/448,681 and EP Patent Application 12164150.0 are each incorporated herein by reference in its entirety for all purposes.

FIELD OF THE INVENTION

The present invention relates generally to trays and components for preparing trays that include a tray insert and a cover. The tray components include one or more features that improve the ease of assembly and/or improve the durability of the tray during assembly.

BACKGROUND OF THE INVENTION

There has been considerable interest in trays that include a structural insert layer that are at least partially covered by an exposed cover layer, such as a decorative cover layer. Such a construction can result in trays that are versatile in construction.

US2010/0294831 A1 (published Nov. 25, 2010), teaches a tray that includes a tray insert that is partially covered by a cover layer. Here, the floor of the tray is not covered and the tray insert is exposed. There is no teaching of covering the floor and there is no means of securing a floor covering in place. This application teaches inserts that include multiple wall layers and laterally securing two portions of a wall together. However, this design allows for movement of the side walls and there is need for tray inserts having side walls that can more easily be fit into place and/or secured in place.

US2011/0155797 A1 (published Jun. 30, 2011) describes various methods for attaching a cover to a tray, including the use of an adhesive or tape. Another methods of attachment that is described employs a cover having a tab which and a tray insert having a slot in its base, and sliding the tab through the slot so that it contacts the outer (i.e., bottom) surface of the insert base. Another method of attaching described employs a cover that covers only a fraction oof the the wall surfaces of the tray insert and/or requires a distal tab to fit either downward or upwards into a slot midway up the side wall of the tray insert.

U.S. Pat. No. 7,044,359 B1 (Issued May 16, 2006) describes trays that include three separate components, an insert, a cover, and a floor and requires that the floor is bonded in place.

There remains a need for improved trays and tray components, such as tray inserts and covers, which are easier to assemble. For example, there is a need for tray inserts that can easily be folded and securely lock into a tray shape with upright sides. As another example, there is a need for inserts that includes slots for securing a cover in place. Such slots could be used for engaging with a projection from a floor portion, such as a floor portion that is integrated with the cover, a separate floor portion, or a floor portion that is integrated with a neck. As yet another example, there is a need for a cover that includes slots for securing a floor portion. There is also a need for a cover that includes an integrated floor portion.

There also remains a need for tray inserts that are more resilient during assembly. For example, there is a need for tray inserts that includes slits, creases, or other features that allow for the tray insert to be arranged into a tray shape and/or covered without permanently deforming the base.

There is also a need for tray inserts that have cut-out regions capable of hiding folded webbings and/or folded tabs of a cover so that these webbings and tabs do not show through the cover.

There is also a need for a tray kit that includes an improved tray insert and/or an improved cover. Additionally, there is a need for a tray kit that is partially assembled, yet allows for ease of shipment of the tray kit in a generally flat shape.

SUMMARY OF THE INVENTION

The present invention meets one or more of (e.g. all of) the above needs using tray components that include features that improve the ease of assembling the tray and/or improve the durability of the tray during assembly. The features can be used alone. However, a number of the features, when combined, result in particularly robust assembly processes.

One aspect of the present teaching is directed at a cover for wrapping a tray insert, wherein the cover includes a cover base having a generally polygonal shape with 3 or more side edges; a plurality of first cover flaps, each connected to a different side edge of the cover base; a plurality of second cover flaps, each connected to a different first cover flap; a plurality of third cover flaps, each connected to a second cover flap, and a floor cover portion. The floor cover portion may include a floor cover base having a polygonal shape with 3 or more side edges, wherein the polygonal shape of the floor cover portion is generally the same shape as the cover base. The floor cover portion includes one or more floor securing protrusions, preferably connected to at least one side edge of the floor base, and more preferably connected to two or more side edges of the floor base. The cover includes a sufficient number of floor cover securing features (e.g., cover slots) located in the second cover flaps and positioned for receiving the one or more floor securing protrusions of the floor cover portion. Preferably, the number and length of the floor securing protrusions and the number of cover slots are sufficient for securing the floor cover portion to a tray insert, to the second cover flaps, or both, without the use of adhesive, tape, or other bonding means for securing the floor cover portion in place.

Another aspect of the present teachings is directed at a tray insert for a tray that includes a tray base and a plurality of side walls connected to the side edges of the tray base, wherein the side walls include wall anchoring protrusions, and the tray insert includes wall anchoring slots capable of receiving the wall anchoring protrusions. The wall anchoring slots preferably are located at or near one or more side edges of the tray base. Preferably the tray base includes one or more flexing slits so that the tray base can be flexed for receiving a wall anchoring protrusion into a slot. Preferably the tray insert includes a flexible locking portion capable of flexing in one direction for allowing easy entry of a wall anchoring protrusion into a slot, capable of flexing in one direction (e.g., a different direction) for securing a wall anchoring protrusion in a slot, or both.

Another aspect of the present teachings is directed at a tray insert for a tray that includes a tray base and a plurality of side walls connected to the side edges of the tray base, wherein the side walls include one or more cut-outs for receiving and/or hiding a folded portion of a cover (e.g., having multiple layers). The tray insert cut-out may be employed for hiding a webbing of a cover when it is in a folded arrangement.

Yet another aspect of the present teachings is directed at a tray, including a tray insert according to the teachings herein, a cover having a floor cover portion according to the teachings herein, or both. The floor cover portion preferably includes a floor base and a plurality of floor securing protrusions attached to the side edges of the floor base. Preferably the tray insert includes corresponding features for receiving the floor securing protrusions so that the cover can be secured to the tray insert (e.g., without the need for adhesive, tape, or other bonding agents).

A further aspect of the present teachings is directed at a kit for a tray including a tray insert according to the teachings herein, a cover according to the teachings herein, or both.

The tray inserts, covers, and trays according to the teachings herein may be used for a box compartment, a box lid, or both.

A method aspect of the present teachings, is directed at a method for assembling a tray including a step of flexing an insert base so that a floor securing anchor can be inserted into a floor securing slot, wherein insert base includes a sufficient number of slits so that the force needed to flex the insert base is reduced, so that the insert base can be sufficiently flexed without breaking, or both.

Another method aspect of the present teachings is directed at a process for assembling a tray including a step of securing a floor cover portion by sliding a floor securing protrusion into a slot in a cover, in a tray insert, or both.

BRIEF DESCRIPTION OF THE DRAWINGS

FIG. 9 is the top view of FIG. 8, with the tray insert shaded in.

FIG. 12 is an illustrative assembled tray including a tray insert, a cover, and a neck component. As shown in FIG. 13, the cover may have a graphic and/or text on a show surface of the cover.

FIG. 13 is an illustrative assembled tray including a tray insert, and a cover having an integrated floor cover portion.

As illustrated in FIG. 15, the floor cover portion may be secured to the tray insert using a protrusion from the floor cover portion that is inserted into corresponding slots of the tray insert and the cover, without penetrating through the tray insert.

As illustrated in FIG. 16C, the floor cover portion may be secured to the tray insert using a protrusion from the floor cover portion that is inserted into corresponding features of the tray insert and the cover, without penetrating through the tray insert.

DETAILED DESCRIPTION

Figure 1:
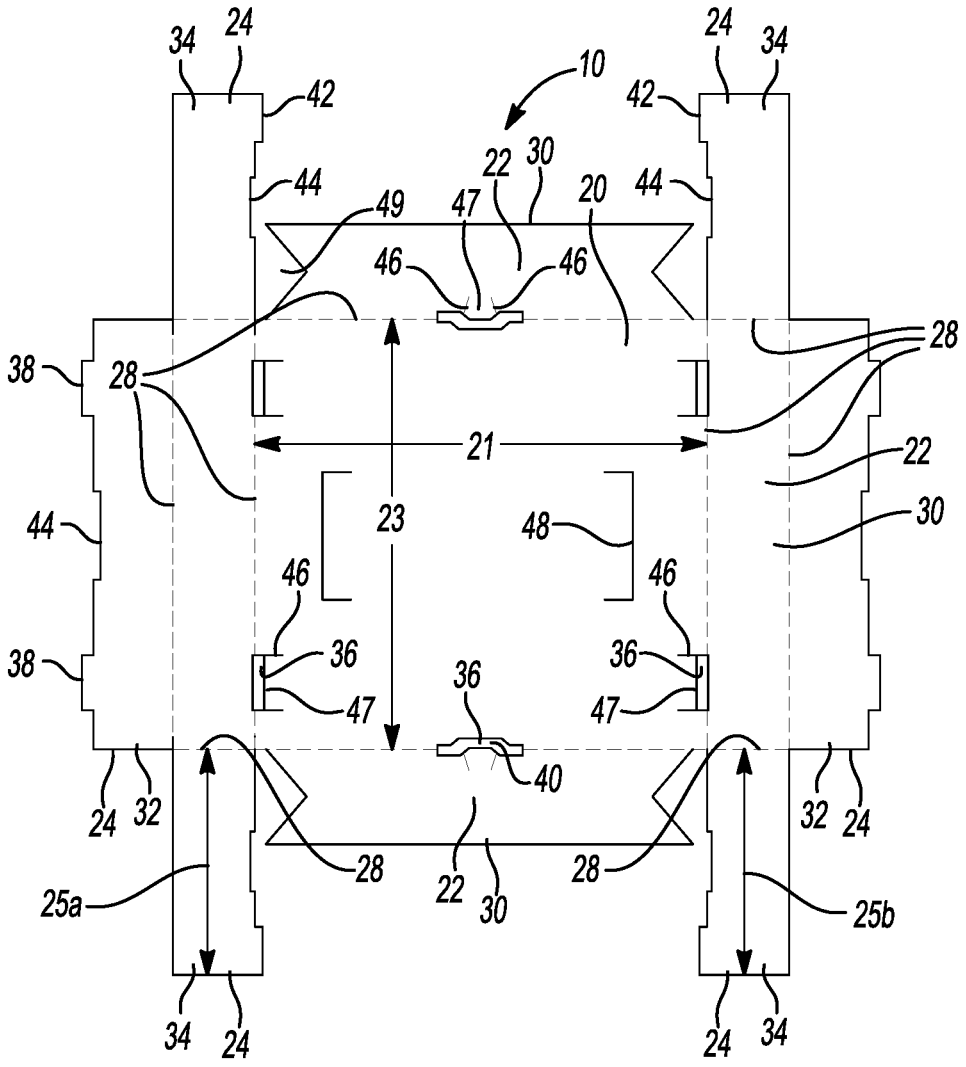
FIG. 1 is an illustrative tray insert including one or more features for enabling the securing of a cover to the tray insert, one or more features for securing the upright walls of the tray insert in position, one or more cut-out regions, and one or more features for improving the resiliency of the tray insert during assembly.

In general, the tray components according to the teachings herein, have one or more features that improve the ease of assembling the tray components into a tray; that improve the durability of one or more tray components, particularly during assembly; that improve the appearance of the assembled tray; or any combination thereof. The trays are assembled from at least two components, including a tray insert component (i.e., a tray insert) that generally provides a rigid or support structure to the tray, and a cover component (i.e., a cover) which provides a decorative or protective cover to surfaces of the tray. The tray will include a floor cover portion for covering the inside floor of the tray insert. This floor cover portion preferably is provided as an integrated part of the cover. However the floor cover portion may also be provided as a separate component, or integrated with an additional component, such as with a neck component.

The tray insert component preferably includes 1) one or more features that allows for the securing of a cover and/or a floor cover portion to the tray insert; 2) one or more features that improves the durability of the tray insert; 3) one or more features that improves the secured positioning of an upright side wall; 4) one or more features that improves the aesthetics of the tray; or any combination thereof.

The cover component preferably includes 1) an integrated floor portion; 2) one or more features that allow for the securing of the cover to a tray insert; 3) one or more features that allow for the securing of a floor cover portion to the cover; 4) one or more features that facilitates the positioning of and/or maintaining the position of a tray insert component relative to the cover component; or any combination thereof.

The tray is prepared by wrapping the tray insert component with the cover component, and optionally one or more additional components, so that the some or all of the surfaces of the tray insert component are generally hidden from view. When used in a tray, the surfaces of the tray insert component may be partially hidden from view. Preferably, when used in a tray, some or all of the surfaces of the tray insert are completely hidden from view. As such, the tray insert component may be considered to be partially or completely "wrapped" by the cover component. Just as a mundane gift may be wrapped with exciting wrapping paper, a tray insert may be wrapped with cover component to provide a desired aesthetic and/or informative appearance to the tray. Some cover components according to the teachings herein are able to substantially, or even entirely hide all of the surfaces of the tray insert component. Other cover components according to the teachings herein are able to substantially, or even entirely hide all of the surfaces of the tray insert component with the exception of a portion of the floor of the insert base. In such a situation, one or more additional components will generally be employed to cover the floor of the insert base.

The components herein may be used for preparing a tray having a generally polygonal base with n sides, where n is 3 or more. Trays, and particularly trays that are employed for a box compartment or a box lid, often have n=4 sides. As such, the teachings herein will generally focus on such trays, and more particularly trays having rectangular bases. However, it should appreciate the teachings herein can also be applied to trays having different number of sides, having one or more sides that is not parallel to another side, having an even number of sides, or having an odd number of sides, having one or more sides with a length differing from one or all of the other sides, or any combination thereof. The base of the tray may generally be thought of as being position on a horizontal plane. The base may be generally flat. However, the base may be formed to have minor amounts of curvature. The tray generally has upright side walls rising vertically from the base. The height of the upright side walls will generally be uniform for a given upright side and constant between the upright side walls. However trays in which one or more upright side wall vary in height and/or in which one or more side wall have a height that is different from the height of an opposing upright side wall may also be employed. By way of example, a tray insert may include a generally rectangular insert base having four side walls, including a first side wall with a first height, an opposing side wall having a second height (e.g., greater than the first height), and adjacent side walls that vary in height (e.g., between the first height and the second height).

The features of the components of the tray, taken alone, and in some cases taken as a combination, result in the various improvements, such as discussed hereinbefore.

The tray insert component generally includes, consists essentially of, or consists entirely of, an insert base portion and an upright side wall portion. The insert base portion may provide the structural support for the base of the tray. The insert base portion may consist essentially of a polygonal insert base (having the same n sides as the tray discussed hereinbefore). The upright side wall portion includes all of the portions of the insert tray component that can be folded or otherwise arranged to be in a generally upright position (e.g., having a normal direction that is at an angle of about 90° relative to the normal direction of the insert base). The upright side wall portion preferably includes a sufficient amount of side walls so that each of the n side of the insert base has at least one upright side wall.

With reference to FIG. 1, the tray insert 10 has an insert base 20, and each edge of the insert base 20 may have a first insert flap 30 capable of forming a side wall. Optionally, the tray insert 10 includes additional insert flaps 32, 34, capable of reinforcing the side walls. For example, the tray insert may include distal insert flaps 32, lateral insert flaps, or both. As illustrated in FIG. 1, one or more first insert flaps 30 may include a flap 32 attached in a distal direction capable of reinforcing the first insert flap with a second wall layer. Similarly, one or more of the first insert flaps 30 may include one or more (preferably two) flaps 34 located on the lateral ends of the first insert flap which are capable of being folded with respect to the first insert flap 30 for reinforce the upright side wall 12 along an adjacent side of the insert base 20.

The cover component 8 generally includes a base covering portion 86, a side wall covering portion 84, and optionally a floor covering portion 70. When used, the cover component 8 will generally have one side that is visible (i.e., a show surface 80) and one side that is hidden from view. As such, the cover component may have surfaces that are different so that the only the show surface has a desired appearance. It will be appreciated that the cover component may be reversible (e.g., having two show surfaces that are the same or different), or may have one surface that is identified or marked so that the show surface is employed as the visible surface. The base covering portion of the cover component generally will be employed to cover the bottom surface 27 of the tray insert 10 (i.e., the bottom of the tray base). The base covering portion 86 may include or consist essentially of a cover base 50. As such, the cover base 50 and the base 20 of the tray insert 10 may generally have the same lengths and widths. The side wall covering portion 84 of the cover component 8 generally will be employed for covering the outwardly facing surfaces and the inwardly facing surface of the upright side walls 12 of the tray insert component 10. If included in the cover component 8, the floor covering portion 70 will generally be employed for covering the floor 26 of the insert base 20 (i.e., the top surface of the insert base).

Figure 2:
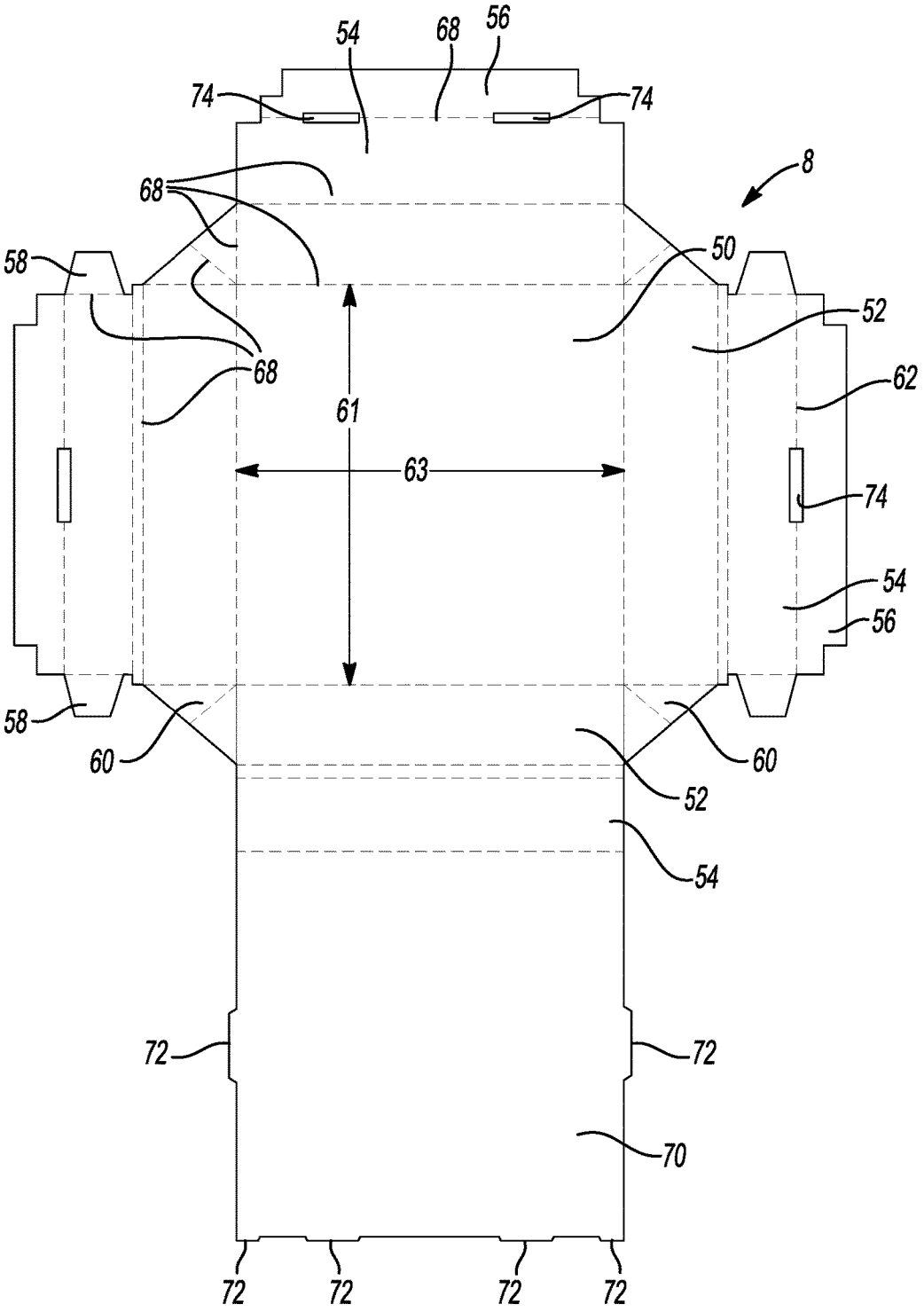
FIG. 2 is an illustrative cover that includes a floor cover portion. The cover may be employed in covering a tray insert, such as the tray insert of FIG. 1. The cover includes one or more features for securing the floor cover portion to the cover, and for securing the floor cover portion to an insert.

With reference to FIG. 2, the side wall covering portion 84 of the cover component 8 may include a plurality of first cover flaps 52 (e.g., extending from the side edges 51 of the cover base 50), a plurality of second cover flaps 54 (e.g., extending from outer, or distal edges 53 of the first cover flaps), a plurality of third cover flaps 56 (e.g., extending from outer, or distal edges 55 of the second cover flaps 54), or any combination thereof. With reference to FIG. 2, each side edge 51 of the cover base 50 may have a first cover flap 52, each first cover flap 52 may have a second cover flap 54, each second cover flap may 54 have a third cover flap 56, or any combination thereof.

The cover component preferably is formed from a material that is sufficiently flexible so that the cover component may easily be folded around the tray insert, as discussed herein.

As discussed hereinbefore, the cover component 8 may include one or more features that facilitate the assembly of a tray 2. For example, the cover component 8 may contain one or more floor cover securing features 74 (e.g., such as a cover slot or other opening) capable of receiving and/or engaging a floor securing protrusions of a floor cover section 70. The floor cover securing features 74 of the cover component 8 preferably are located in the second cover flap 54 (e.g., at or near a crease line 68 between the second cover flap 54 and the third cover flap 56. The floor cover securing features 74 may be any shape and size. The position and/or shape of a floor cover securing features 74 should be chosen so that a floor securing protrusion 72 from a floor cover section 70 can engage with the cover slot. Preferably the floor cover securing features 74 has an elongated shape. For example, the floor cover securing features 74 may be rectangular in shape, with an aspect ratio greater than 1. Preferred floor cover securing features 74 have an aspect ratio of about 3 or more, about 6 or more, or about 12 or more. As such the floor cover securing features 74 may have a long direction and a short direction. The long direction of a floor cover securing features 74 preferably is parallel with and spaced apart from the crease line between the first cover flap 52 and the second cover flap 54. Preferably the floor cover portion includes a sufficient number of floor securing protrusions having sufficient length, so that there is no need for the cover component to include tabs on the third cover flaps 56 for engaging with a slot in the insert. As such, the cover component 8 may be substantially free, or entirely free of tabs connected to the third cover flaps 56. Such tabs are particularly undesirable if they slide through a slot in an insert 10 and contact (e.g., rest against) an outer or bottom surface of the insert 10. For example, such tabs may undesirably show through the cover (e.g., as a raised region) and/or may present difficulties during assembly.

The floor cover securing features 74 may be positioned in any location of the second cover flap 54. When the floor cover securing features 74 is used for engaging a floor securing protrusion 72 from a floor covering portion 70 that is attached to the cover 8, or for engaging with a floor covering portion 70 that is provided as a separate blank consisting essentially of a floor covering portion, it is preferable that the floor cover securing features be located near a third cover flap (which may be a distal tab) 56, so that the floor covering portion 70, including any floor securing protrusions 72 may maintain a substantially planar arrangement with respect to the insert base 20 when engaged with the floor cover securing features 74. The floor covering portion 70 may also be secured using floor cover securing features 74 (such as side slots) that are positioned away from the third cover flaps 56. For example, a floor covering portion 70 that is attached to a neck component 6, may be secured using floor securing protrusions 72 created from and extending outwardly from the upright walls 100 of the neck assembly 6. The floor cover securing features 74 may extend partially into the third cover flaps 56, so that the floor securing protrusion 72 easily slides into and engages with the floor cover securing features 74 and/or the floor cover securing features 74 may be positioned near the bottom of the second covered flap 54 (as assembled) for improved aesthetics. Preferably the floor securing protrusions 72 engage with the floor cover securing features 74 in a reversible manner so that the cover component 8 can be removed from the tray insert if desired 10.

The number of floor cover securing features (e.g., cover slots) 74 should be sufficient for securing the floor section 70 without the need for adhesive, tape, or other bonding material. Although a single floor cover securing features may be sufficient for securing the floor section 70 in place, it is preferable that the cover component 8 include a plurality of floor cover securing features 74 (e.g., two or more, three or more, four or more, five or more, or six or more). For example, the cover component 8 may include one or more floor cover securing features 74 on each of two opposing second cover flaps 54. In a preferred example, the floor covering portion 70 is attached to one of the second cover flaps 54 of the cove component 8, and the other second cover flaps 54 each have one or more floor cover securing features 74. Second cover flaps 54 having floor cover securing features 74 may have the same number of floor cover securing features, or may have different number of floor cover securing features. For example, one side may have one floor cover securing features and an adjacent side may have two or more floor cover securing features. In another preferred example, a floor cover portion 70 is not attached to the cover component 8 and the floor cover portion (or neck assembly) is secured on each second cover flap 54 with one or more floor cover securing features.

As discussed hereinbefore, the tray insert component 10 may include one or more features for improving the aesthetics of the tray 2, such as by hiding one or more features of the cover component 8. The tray insert 10 preferably includes one or more insert cut-outs 49 for receiving a folded webbing 60. Such an insert cut-out 49 may partially or completely hide the folded webbing 60, so that the cover component 8 has a generally smooth surface over all upright side walls of the tray insert 12. Without the insert cut-outs 49, the folded webbing 60, or another component of the cover component 8, may "show through" the surface of the cover (e.g., the folded webbing 60 may appear as a raised section of the cover component 8).

The tray insert 10 may include one or more features for securing a floor cover portion 70 (e.g., a floor cover portion that is integrated to a cover, a floor cover portion that is integrated to a neck component, or a floor cover portion that is provided as a separate component from a neck component or an tray insert) to the tray insert. For example the tray insert 10 may include a floor cover securing feature 44 that engages with a feature (e.g., a complementary feature) of the floor cover portion 72. Preferably, the tray insert 10 includes a sufficient number of floor cover securing features 44 so that the floor cover portion 70 remains in place during use of the tray 2. The floor covering securing features 44 preferably does not result in a permanent attachment. For example, it may be advantageous to employ a floor covering securing feature 44 that allows for the removal of the cover component 8 from the tray insert 10 using one or more steps of disengaging the components. The floor cover securing feature 44 may be a slot or a cut-out that forms an opening for engaging a complementary feature (e.g., a feature of a neck component 6 or a feature of a cover component 8), such as a floor securing protrusion 72.

The tray insert 10 may have one or more (preferably two or more) slits positioned adjacent to and connected to a slot (e.g., to a wall anchoring slot), so that a flexible locking portion (e.g., having a wedge shape, a rectangular shape, a trapezoidal shape, a nose-type shape, or any other suitable shape) is formed. Preferably the flexible locking portion is capable of flexing outwardly to allow easier insertion of a feature such as a tab or wall anchoring protrusion into the slot. Preferably, the flexible locking portion is capable of providing pressure against the tab or wall anchoring protrusion so that it remains securely in place. Such a flexible locking portion may be employed for securing an upright side wall of the tray insert in position during assembly, after assembly, or both.

The tray insert may have upright side walls that have single layered walls, doubled layer walls, or even walls having three or more layers when in use. The tray upright walls of the tray insert should be sufficiently thick to provide structural support for the tray. For example, the walls should be sufficiently strong so that a plurality of boxes that include the tray can be stacked when the boxes are filled. The thickness of the upright walls are preferably about 0.3 mm or more, more preferably about 0.6 mm or more, even more preferably about 1.0 mm or more, and most preferably about 1.5 mm or more. The thickness of the tray insert preferably is greater than the thickness of the cover component. The ratio of the thickness of the tray insert to the thickness of the cover component preferably is about 1.2 or more, more preferably about 2 or more, even more preferably about 4 or more, and most preferably about 10 or more. As discussed herein, the tray insert may be sufficiently thick so that crease lines or partial slits or scoring are required to facilitate the folding of the tray insert so that it can be arranged into a tray-like shape. The cover component preferably is sufficiently thin that it is capable of being easily folded (e.g., without scoring or slitting). Preferably, the cover component has a thickness of about 0.5 mm or less, more preferably about 0.3 mm or less, even more preferably about 0.2 mm or less, and most preferably about 0.1 mm or less.

It will be appreciated that the tray insert may be provided in a tray-like configuration so that no further assembly (e.g., folding of a flap) of the tray insert is required. For example, the pre-assembled tray insert may be a tray insert according to the teachings herein. Other tray inserts may also be employed. For example, a molded or otherwise pre-formed tray insert may be used with a cover component according to the teachings herein. Such a molded or otherwise pre-formed tray insert preferably includes a floor cover securing feature 44, a insert cut-out 49 along one or more side walls (preferably at or near an upright edge) for hiding a portion of the cover component, or both.

The base (e.g., the cover base, the base of the tray, the insert base, or any combination thereof, and preferably all) has a generally polygonal shape. For example the base may have a triangular, or rectangular shape, or a shape having five or more sides (e.g., a pentagonal, hexagonal, heptagonal, or octagonal shape). The base preferably includes one or more pairs of opposing sides that generally have the same length, are parallel, or both. For example, if the base has an even number of sides, each pair of opposing sides may have the same length and be parallel. The base may have adjacent sides that have the same length, or are different lengths. The shape may be a regular polygonal shape, although such a shape is not necessary. For example, the base may have a rectangular shape or a trapezoidal shape.

The cover 8 may include one or more lateral tabs 58 (e.g., extending in lateral direction from the side edges of some of the second cover flaps) During assembly, the lateral tabs may be slide between folded portions of the cover component and thus help secure the cover component in a desired folded arrangement. The cover 8 preferably includes a webbing 60. The webbing may be located and extedn from the lateral edges of two adjoining first cover flaps 52 and may connect the two first cover flaps. The webbing 60 may function to completely cover the outward facing upright edges of a tray 2.

A lateral tabs 58 and a webbing 60 may also be attached so that they are not individually moveable with respect to each other. For example the lateral tab 58 and the webbing 60 may be attached using one or more adhesives, tapes, or fasteners. According to the teachings herein, one preferred arrangement of a cover component is to have two of these tab/webbing attachments. Each tab/webbing attachments requires the folding of one second cover flap with respect to a first cover flap, so that a lateral tab lies planar with a portion of the webbing. By employing two of such tab/webbing attachments on the cover 8, this fold is maintained. By having two opposing sides folded in this manner, an tray insert preferably is generally secured in place. The tray insert may be slid into position after forming the attachments, or an attachment may be made when the insert is in position. As such, the insert and cover 8 may be partially pre-assembled and provided as a single unit (e.g., in a generally flat, planar configuration) for complete assembly at a later time. Alternatively, a user may receive a cover with one or more of such tab/webbing attachments and easily slide an insert into the partially folded cover before completing the folding and covering of the insert.

As discussed herein, the tray insert may include one or more insert slots 44 for receiving a floor securing protrusion (e.g., a protrusion that secures a floor cover portion). The tray insert may have more insert slots than the cover has floor securing protrusions. By providing more insert slots 44 in the tray insert than floor securing protrusions in the floor cover portion, the insert may advantageously be capable of being arranged in a plurality of positions relative to the cover component (i.e., rotations about the normal of the planar surface) and still receive all of the floor securing protrusions of the cover. By way of example, a cover component may have a square cover base with one edge of a floor cover portion attached to one of the second cover flaps of the cover component, and a floor securing protrusion on each of the other three remaining edges of the floor cover portion, with each floor securing protrusion having a similar shape and position; and the tray insert may include a insert slot on each of its sides for receiving one of the floor securing protrusions. Here, the tray insert and the cover component may be arranged in any of the four positions in which the bases will align, without concern that there will be an insert slot for each of the floor securing protrusions.

A tray insert 10 including a plurality of features for improving the ease of assembly, for producing a more aesthetically uniform tray, and improving the durability of the insert during assembly is shown in FIG. 1. The tray insert generally includes an insert base 20 having a polygonal shape having n side edges. As illustrated in FIG. 1, the insert base 20 may have a generally rectangular shape with n=4 sides. It will be appreciated, according to the teachings herein, that the insert base 20 may have more or fewer side edges (generally n is 3 or more). The tray insert 10 may include a sufficient number of first insert flaps 30 so that that a first wall can be formed for each side edge of the insert base 20. For example, the insert base 20 may include a first insert flap 30 attached to each side edge 29 of the insert base 20. As such, a rectangular insert base 20 may have four first insert flaps 30. The tray insert 10 may include a crease 28 or other feature to allow the inward folding of the first insert flaps 30 relative to the insert base 20. When folded inward (e.g. by 90°), the first insert flaps 30 become side walls 22.

The tray insert 10 may include a sufficient number of additional flaps for reinforcing the side walls of a tray. The number of additional flaps 32, 34 may depend on the functional needs of the tray and/or a desired appearance of the tray. For example, as illustrated in FIG. 1, the tray insert may include a sufficient number of additional flaps 32, 34 so that each side of the tray has a wall that is generally twice the thickness of the tray insert 10. One or more of the first insert flaps 30 may include a distal insert flap 32 and/or a lateral insert flap 34. For example, half of the first insert flaps may each include one distal insert flap 32 and one or more (e.g., two) lateral insert flaps 34. It will be appreciated that some of the first insert flaps 30 have additional flaps 32, 34. Such a first insert flap can be reinforced (e.g., to form a double thickness side wall) by folding the adjacent lateral insert flaps inward 34 (e.g., at about a 360°/n, or 360°/n=90° angle relative to the first insert flap 30 to which it is connected). The distal insert flaps 32 may be employed to reinforce the first insert flap 30 to which it is attached. For example, the distal insert flap 32 may be folded inward by about 180° so that the thickness of the side wall is generally doubled.

The insert base 20, may have one or more sides having a first length 21 and one or more sides having a second length 23 which may be the same or different from the first length. The insert base may include a first insert flap 34 having a length 25*a* and a second insert flap 34 having a second length 25*b*, where the combined lengths of the two second insert flaps (25*a*+25*b*) is about the length 21 of the side of the insert base that separates the two second insert flaps. For example, as illustrated in FIG. 1, the insert base may be a rectangle with a width 23 and a length 21, and one or more pairs of second insert flaps having lengths of 25*a* ,25*b* where the sum of the two lengths 25*a*, 25*b* is about equal to the length 21.

When the tray insert has a wall with double thickness, some of the insert flaps 30, 32, 34 will become inner side walls 24 and some will become outer side walls 22. With reference to FIG. 1, the first insert flaps 30 preferably become outer side walls 22 and the distal insert flaps 32 and the lateral insert flaps 34 may become inner side walls 24. Such an arrangement may allow for the securing of the inner side walls (e.g., the distal insert flaps 32, the lateral insert flaps 34, or both) to the insert base 20. The securing of the side walls may employ a mechanical fastening means. The side walls may be secured by fitting one or more wall anchoring protrusions into a slot. For example, as illustrated in FIG. 1, a distal insert flap 32 may include or more (e.g., about 2) wall anchoring protrusions 38 extending distally from its side edge and the insert base 20 may include a sufficient number of slots 36 for receiving the wall anchoring protrusions. The insert base 20 may also include one or more insert slits 46 extending from a slot 36. If employed, the insert base slits 46 should be sufficiently long so that the wall anchoring protrusions 38 can easily be fit into the slot 36. Preferred insert slits 46 are sufficiently short so that the strength of the insert base 20 is not significantly affected. The ratio of the length of the insert slit 46 to the length of the insert base 20 (e.g., in the general direction of the slit) is preferably about 0.25 or less, more preferably about 0.15 or less, even more preferably about 0.10 or less, and most preferably about 0.05 or less. The side insert flaps 34 preferably includes one or more wall anchoring wall anchoring protrusions from a side edge that will contact with the insert base 20 when the tray insert is folded into a tray-like shape. The insert 10 preferably includes corresponding slots (e.g., wall anchoring slots) 40 for receiving the wall anchoring protrusions 42. It will be appreciated that two wall anchoring protrusions 42 from different lateral insert flaps 34 may fit into a single slot 40. The slot 40 preferably is located near a side edge 29 of the insert base 20. The wall anchoring protrusion 42 preferably is chosen to have a dimension that fits tightly into the slot 40. The insert may include one or more insert slits 46 extending from the slot 40 and into a first insert flap 30. Such a slit 46 in the first insert flap 30 may allow for ease of assembly of the tray insert 10. For example, the slit 46 may form a flexible locking portion 47 in a first insert flap 30 adjacent to a slot 40. The flexible locking portion 47 may be capable of flexing outward so that a wall anchoring protrusion 42 can easily be inserted into the slot 40. The flexible locking portion 47 may be capable of exerting an inward force onto a wall anchoring protrusion 42 that is inserted into the slot 40 so that the wall anchoring protrusion 42 is generally secured in the slot 42. A single flexible locking portion 47 may be capable of securing two wall anchoring protrusions 42 from different lateral insert flaps 34 (e.g., two lateral insert flaps 34 that abut edgewise when inserted into a slot 40).

The insert may include one or more floor cover securing features 44 (such as a cut-out or a slot) that is capable of engaging with a floor cover portion so that the floor cover portion so that the floor cover portion can be secured to the tray insert. The floor cover securing feature may be on insert flaps 30, 32, 34 that form inner side walls 24. Such floor cover securing features 44 may be on one, two, or even all of the inner side walls 24. The number of floor securing features 44 should be sufficient for receiving each of the corresponding wall anchoring protrusions of a floor cover portion. It will be appreciated that one or more inner side walls may be free of a floor cover securing feature 44. Preferably, the positioning of floor cover securing features 44 on the various inner side walls 24 has a rotational symmetry so that a floor cover portion can be positioned in more than one orientation.

The insert base 20 may include one or more flexing slits 48 capable of allowing the insert base 20 to be flexed in one or more directions without breaking or creasing the inert base 20. Such a flexing slit 48 may be particularly useful for improving the ease of inserting a wall anchoring protrusion 42 from a lateral insert flap 34 into a slot 40. The flexing slits 48 are especially useful when employing two lateral insert flaps 34 that abut edgewise when inserted into a slot 40. Such flexing slit 48 may result in a insert base 20 that is more resilient and durable during the assembly process and/or result in an assembly process that is more robust. The insert base 20 preferably includes two or more regions having flexing slits 48. With reference to FIG. 1, the insert may include a region having a plurality (e.g., two or more, or three or more) flexing slits 48 that intersect or interconnect. For example, the region may include a first flexing slit 48 and two flexing slits 48 at or near opposing ends of the first flexing slit. Flexing slits 48 will generally extend through the thickness of the insert base 20. It will be appreciated that a flexing slit 48 may be a replaced with a score that partially penetrates the thickness of the insert base 20 (such as a score that penetrates about 20% or more, about 50% or more, or about 70% or more of the thickness of the insert base 20.

Preferably the flexing slit 48 is not attached to a slot in the insert base 20. Such slots may reduce the strength of the insert base 20 and/or present a location for the tray to fail (e.g., by an object penetrating through the cover 8 in a region over a slot, where the cover is not supported by the insert base 20. If a flexing slit is attached to a slot on an insert base 20, the ratio of the longest dimension of the slot to the longest dimension of each of flexing slits to which it is attached is preferably about 0.5 or less, more preferably about 0.3 or less, and most preferably about 0.2 or less.

The insert base 20 is preferably sufficiently solid so that when the insert base 20 is placed over the cover base 50, the cover base 50 does not show through any slits, holes or slots in the insert base 20, except perhaps at locations along the periphery of the insert base 20. Such an insert base may provide superior structural support and protection for the cover. Preferably, the insert base 20 is substantially free of or even entirely free of slots or other openings, except for slots near the side edge of the insert base 20, such as wall anchoring slots according to the teachings herein.

The insert base may include one or more insert cut-outs 49 on a first insert flap 30. The insert cut-outs 49 preferably have a sufficient size so that they can receive an edge fold (e.g., from a webbing) of a cover 8. Such an insert cut-out may hide the webbing 60 of a cover 8 so that it does not show through the tray 2. Preferably, the insert includes at least (e.g., exactly) one cut-out 49 for each of the n upright edges of the tray. Although each first insert flap 30 may include one insert cut-out, it will be appreciated that some first inert flaps 30 may have two insert cut-outs 49 and some first insert flaps 30 may have no insert cut-outs 49. For example, as illustrated in FIG. 1, half of the first insert flaps 30 may have two insert cut-outs 49 and the adjacent insert flaps 30 may be free of insert cut-outs 49. When the tray insert 10 is designed to have side walls that are reinforced by one or more additional layers, it is generally sufficient for the insert cut-outs 49 to only be present in the outer side walls 22. As illustrated in FIG. 1, one or more of the inner side walls may be free of insert cut-outs (e.g., along a corner of the tray 2). When employing an insert cut-out 49 for hiding a folded webbing 60 of a cover 8, it is preferred that the adjacent first insert flap 30 does not include extensions pieces that fill in the space of the insert cut-outs 49. Such extension pieces are taught by US Patent Application 2011/0155797 (paragraph 0059) and defeat the utility of the insert cut-out 49 according to the teachings herein.

The tray insert 10 may include one or more insert creases (e.g., fold lines) 28 for ease of assembly. Such insert creases 28 are preferably positioned where the insert will be folded during assembly. The insert creases 28 may be sufficiently scored (e.g., partially or entirely scored) so that the insert may be folded to form a tray shape. For example, the tray insert 10 may include an insert crease 28 along the edge between the insert base 20 and a first insert flap 30, along the edge between a first insert flap 30 and a distal insert flap 32, along the edge between a first insert flap 30 and a lateral insert flap 34, or any combination thereof (preferably, the tray insert 10 includes an insert crease 28 along all of these edges).

A cover component 8 that including features according to the teachings herein is described in FIG. 2. FIG. 2 shows the top surface of a cover component prior to folding the cover component. This cover component and/or features of this cover component may be employed for covering a tray insert 10 to form a tray 2 according to the teachings herein. By way of example, the cover component 8 described in FIG. 2 may be used for covering a tray insert 10 having some or even all of the features described in FIG. 1. The cover component may have a cover base 50 having a generally polygonal shape as described herein. The cover base in FIG. 2 has a generally rectangular shape. However, the general teachings may be applied to a cover base having a polygonal shape with n=3 or more sides. Each side edge 51 of the cover base 50 preferably has a first cover flap 52 extending outward. Each first cover flap 52 preferably has a second cover flap 54 extending from its side edge 53. One of the second cover flaps 54 may include a floor cover portion 70 extending from its side edge 55. Each of the other second cover flaps 54 preferably has a third cover flap 56 (e.g., a distal cover flap) extending from its side edge 55. The cover component 8 preferably includes webbings 60 that connect pairs of adjacent first cover flaps 52 and extend from the lateral edges of the first cover flaps 52. The floor cover portion 70 preferably includes a plurality of floor securing protrusions 72 for securing the floor cover portion 70 in place. The cover component 8 may include a sufficient number of creases 68 so that the cover component can be folded over a tray insert 10. The cover component 8 preferably includes a sufficient number of cover slots 74 so that each of the floor securing protrusions 72 can be secured in place. Each cover slot 74 preferably is positioned and size so that it is capable of engaging with one of the floor securing protrusions 72. With reference to FIG. 2, the cover flap may be positioned at or near the bottom of a second cover flap 62 (i.e., at or near the interface between the second cover flap 54 and the third cover flap 56. The cover component may also include one or more lateral tabs 58 capable of further securing the cover component in a folded arrangement. The lateral tabs 58 preferably are positioned on lateral side edges of some or all of the second cover flaps. 54. The cover base 50 may have one or more first sides having a first length 61 and one or more second sides having a second length 63, which may be the same or different than the first length. For example, as illustrated in FIG. 2, the cover base may have a generally rectangular shape with a dimensions (i.e., length and width) 61, 63.

Figure 3:
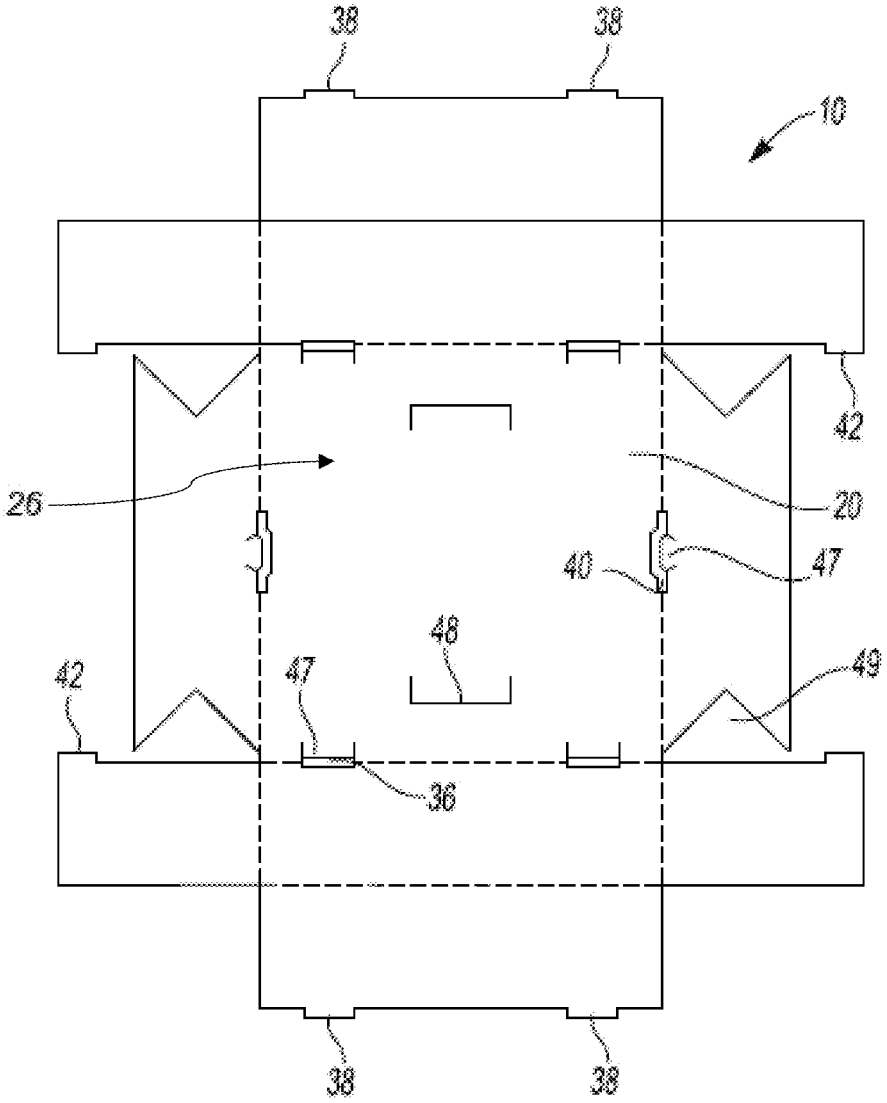
FIG. 3 is another illustrative tray insert including one or more features for enabling the securing of a cover to the tray insert, one or more cut-out regions, and one or more features for improving the resiliency of the tray insert during assembly.

Another tray insert according to the teachings herein is illustrated in FIG. 3. For example, the tray insert 10 may be free of any floor cover securing features 44, such as illustrated in FIG. 3. Here, the floor cover portion 70 may be secured using a floor securing feature in the cover, or by applying an adhesive, tape, or bonding agent. However, it is preferred that the floor over portion 70 is secured without the use of adhesive, tape, or bonding agent.

Preferably, the tray insert 10 is not attached to the floor cover portion using a 70 using an or bonding agent, so that the negative externalities of such processes (e.g., increased assembly time, inferior appearance, increased assembly cost, or any combination thereof) may be avoided.

Figure 4:
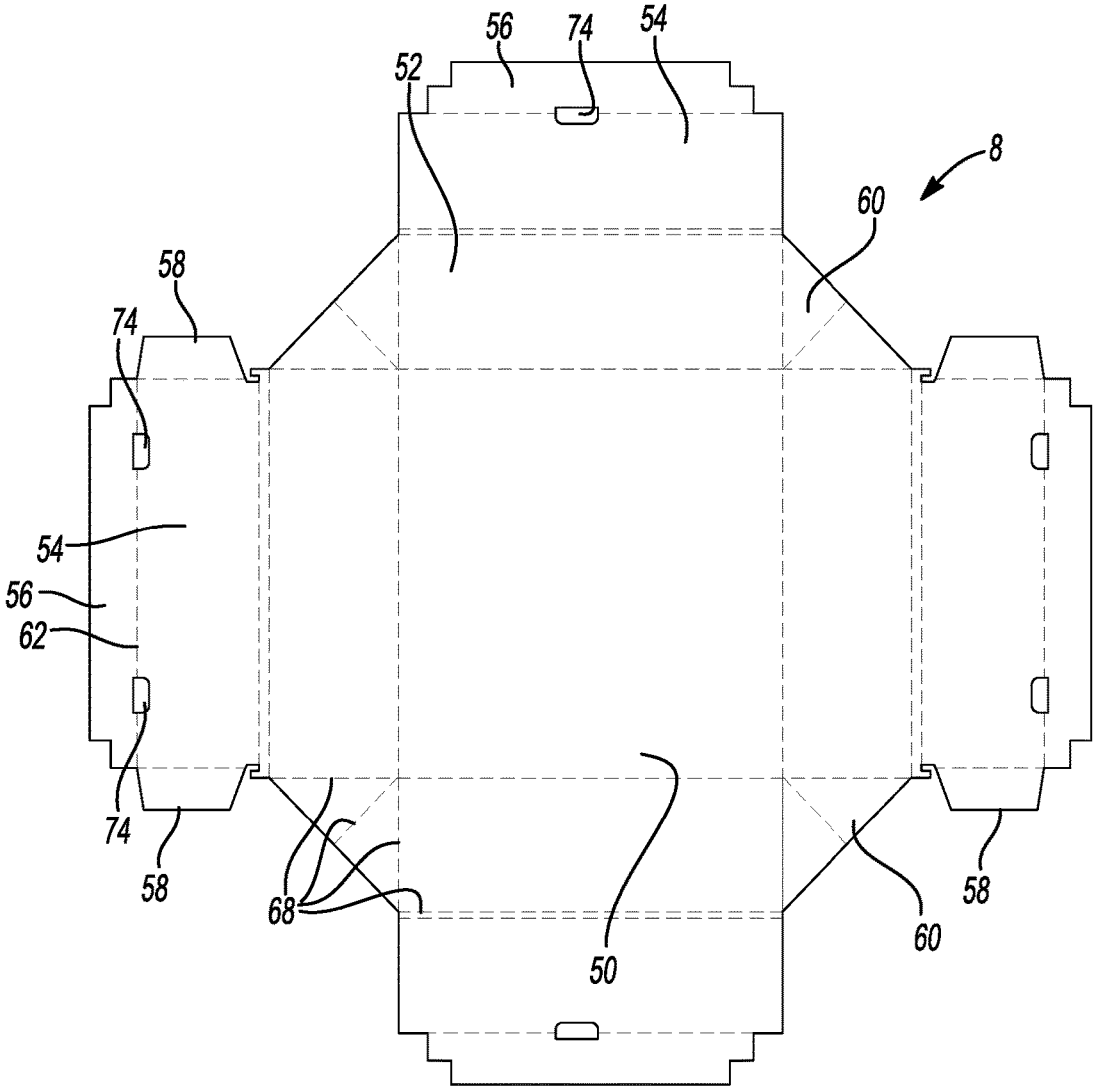
FIG. 4 is an illustrative cover that does not include an integrated floor cover portion. The cover may be employed in covering a tray insert, such as the tray insert of FIG. 3. The cover includes one or more features for securing a floor cover portion (e.g., as part of a neck component) to the cover, and for allowing a floor cover portion to be secured to an insert.
Figure 5:
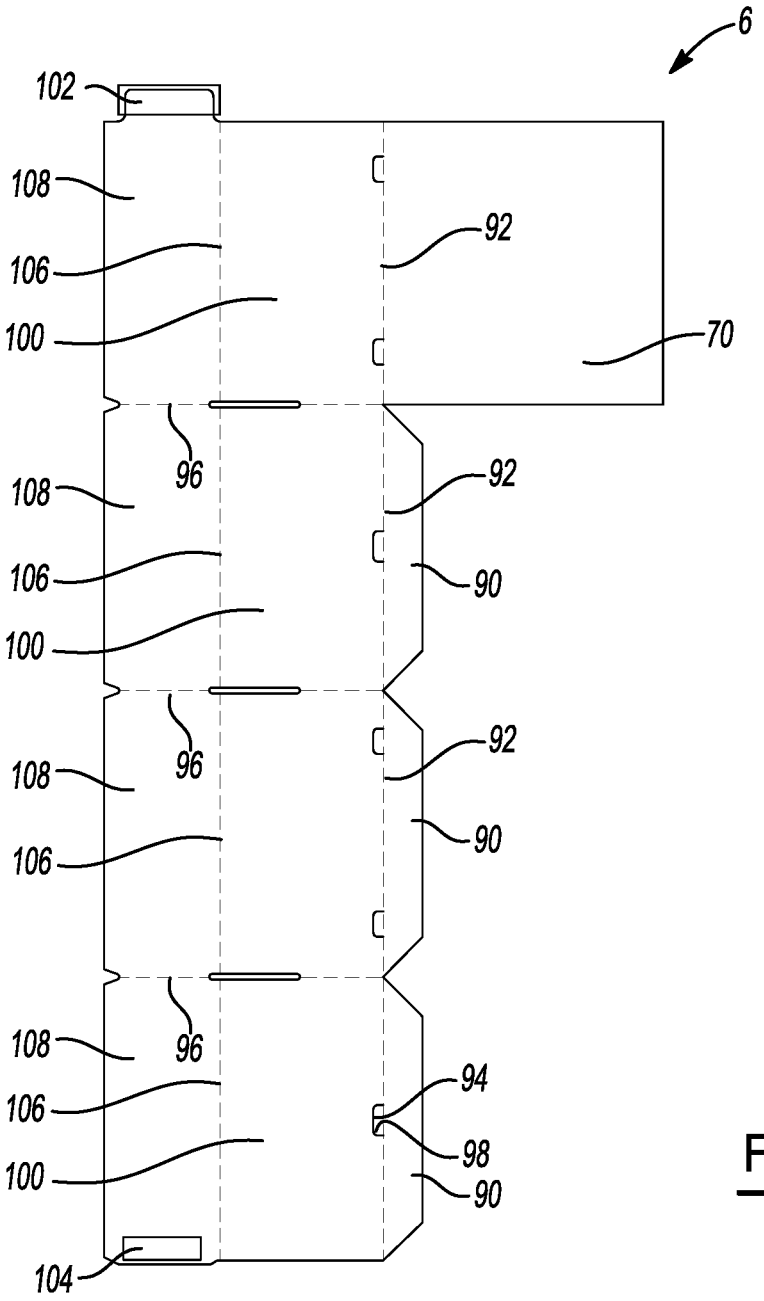
FIG. 5 is an illustrative neck component that includes a floor cover portion. The neck component may be employed with a cover and a tray insert such as the cover illustrated in FIG. 4 and the tray insert illustrated in FIG. 3.

FIG. 4 is an illustrative cover component 8 that does not include a floor cover portion 70. The cover component 8 may include one or more cover slots 74 in each of its second cover flaps 54. The cover component may also include a third cover flap 56 extending from each of the second cover flaps 54. A cover component 8, such as illustrated in FIG. 4 may be incapable of entirely covering a floor 26 of the tray insert 10. The cover component of FIG. 4 may be employed along with one or more additional components (e.g., a neck component) for covering the tray insert 10 illustrated in FIG. 3. For example, a neck component 6 having one or more of the features of the neck component illustrated in FIG. 5 may be employed to cover a floor 26 of a tray insert 10. The neck component includes a plurality of upright walls 100. The number of upright walls may be equal to the number of sides of the insert base. The neck component may include upright walls that are arranged in a consecutive manner, preferably with a crease line 96 between each pair of adjacent walls. One of the upright walls 100 of the neck component 6 may have an integrated floor cover portion 70 at the bottom edge 92 of the upright wall 100. The remaining upright walls 100 may each have a first flap 90 along the bottom edge 92. One or more (e.g., each) wall 100 may have one or more slits 94 positioned along the bottom edge 92. The slits 94 may be shaped and arranged so that when the first flaps 90 of the neck component are folded inwardly, outwardly facing floor securing protrusions are formed from the cut out region 98 of the slits 94. These floor securing protrusions may be positioned for engaging with cover slots, with insert slots, or both so that neck component is secured in place when slid into the opening of a tray insert 10 covered with a cover component. The neck component may include a fastener, adhesive, tape, or other bonding agent 104, for securing the two most distant inner walls 100 and/or the two most distant outer walls 108 when the neck component is folded along the lines (e.g., crease line or score line) 96 between adjacent upright walls. The floor cover portion 70 of the neck component may rest above the inwardly facing first flaps 90. The neck component may include a plurality of inner wall panels 100 and an equal number of outer wall panels 108. Each inner wall panel may be connected to an outer wall panel by a fold crease 106, therebetween. By arranging the neck component so that the inner walls are parallel to the outer walls, it may be possible to have all of the surfaces of the neck component that are visible to be from the same single show surface of the neck component. Such an arrangement may also increase the total wall thickness and/or increase the strength of the walls. For example, the inner walls may be folded over the outer walls and then folds may be made along each pair of adjacent inner walls.

When a neck component and or a separate floor cover component is employed, the cover component 8 preferably includes one third cover flap 56 connected (e.g., connected by a first cover flap and a second cover flap) to each side edge of the cover base 50. For example, the third cover flaps 56 of the cover 8 may be sufficiently in size so that the periphery of the insert base 20 of the tray insert 10 is substantially covered, or even entirely covered by the cover component third cover flaps 56.

Figure 6:
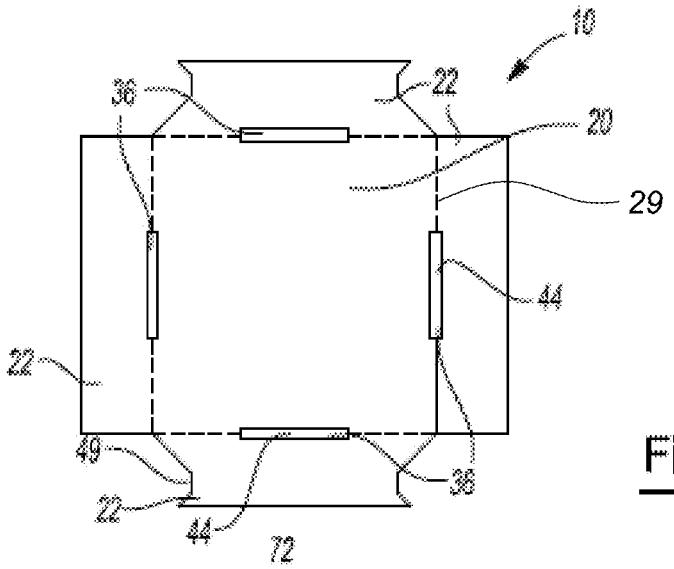
FIG. 6 is an illustrative tray insert having a plurality of features (e.g. slots) for securing a floor cover portion to the tray insert and a plurality of features (e.g., insert cut-outs) for hiding one or more folded sections of a cover.
Figure 7:
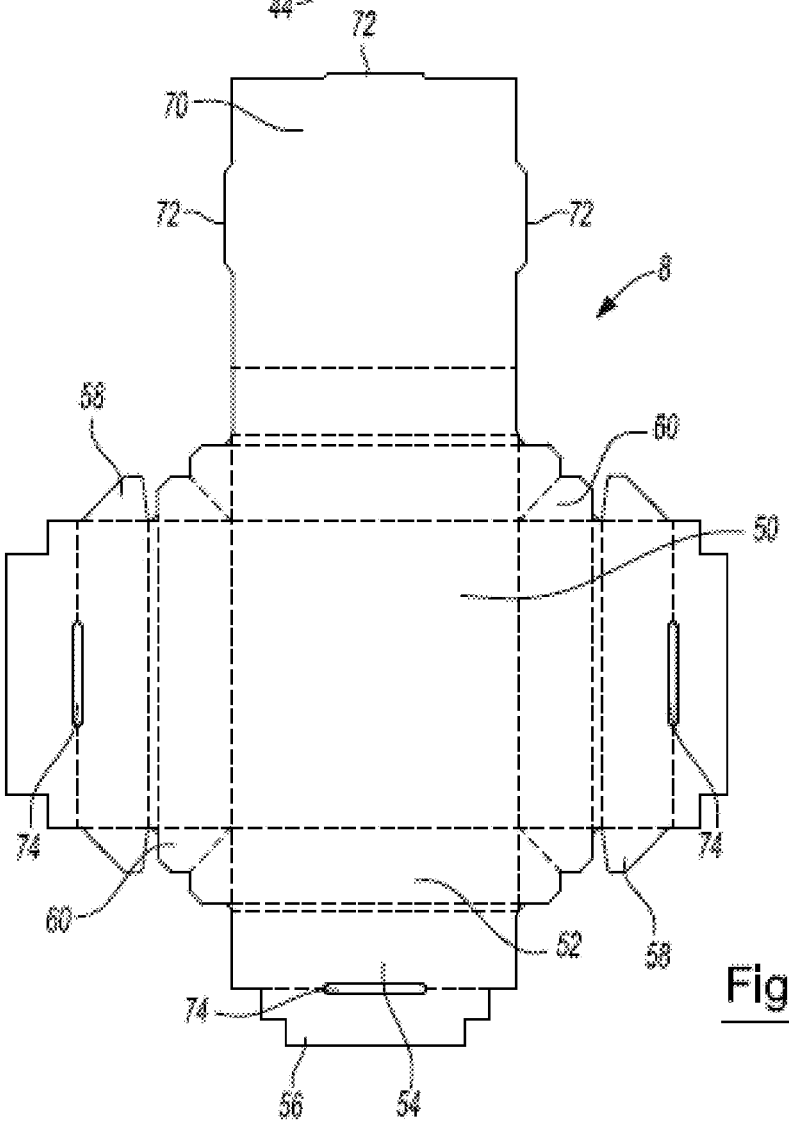
FIG. 7 is an illustrative cover including a floor portion. This cover may be used with to cover a tray insert, such as the tray insert illustrated in FIG. 6.

A tray insert 10 having single thickness side walls 22 is illustrated in FIG. 6. This tray insert 10 may be used with a cover 8, according to the teachings herein. For example, the tray insert may be used with a cover 8 that includes an integrated floor cover portion 70, such as illustrated in FIG. 7. The tray insert includes floor covering securing features 44 on all but one side edges 29 of the insert base 20. These floor covering securing features 44 may be slots running along the side edges 29. The integrated floor cover portion 70 may have one or more floor securing protrusion for fitting into one or more of the floor covering securing features 44.

Figure 8:
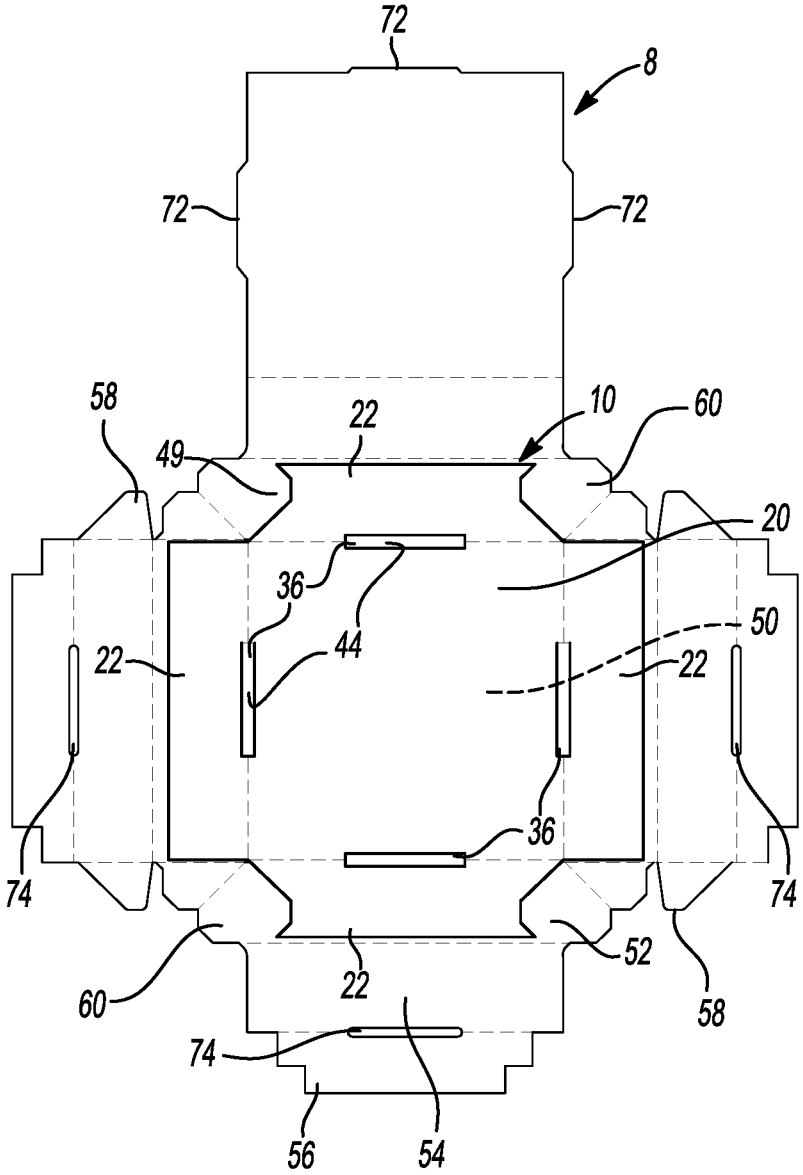
FIG. 8 is a top view illustrating a tray insert of FIG. 6 positioned over a cover of FIG. 7.

An illustrative tray insert 10 and tray cover 8 are shown in an overlain configuration in FIG. 8. Here, the cover tray insert 10 from FIG. 6 is arranged over the cover 8 of FIG. 7. The components are positioned so that the insert base 20 is generally aligned with the cover base 50. The cover base 50 preferably is sufficiently large for covering the bottom surface of the tray base 20 (e.g., they have generally the same length and width). The first cover flaps 52 preferably is sufficiently large for covering the bottom surfaces of the first insert flaps 30 (i.e., the outside walls of the upright side walls when the tray insert 10 is folded into a tray-like shape). For example, the first cover flaps 52 and the first insert flaps 30 may have generally the same length and width. The second cover flaps 54 preferably are sufficient large for covering the top surfaces of the insert flaps (e.g., first insert flaps 30) that form the interior upright side walls of the tray. For example, the second cover flaps 54 and the insert flap 30 may have generally the same length and width. The cover 8 may have third cover flaps 56 which are capable of covering a portion of the floor 26 of the tray insert 10. The cover 8 may include a floor cover portion 70 that is sufficiently large for covering the floor 26 of the tray insert 10. For example, the floor 26 of the tray insert 10 and the floor cover portion may have generally the same width and length. As illustrated in FIG. 8, the cover 8 may include cover securing slots 74 in the regions between the second cover flaps 54 and the third cover flaps 56. The cover securing slots 74 preferably are sufficiently large so that they can receive a floor securing protrusion 72 from the edge of the floor cover portion 70.

Figure 9:
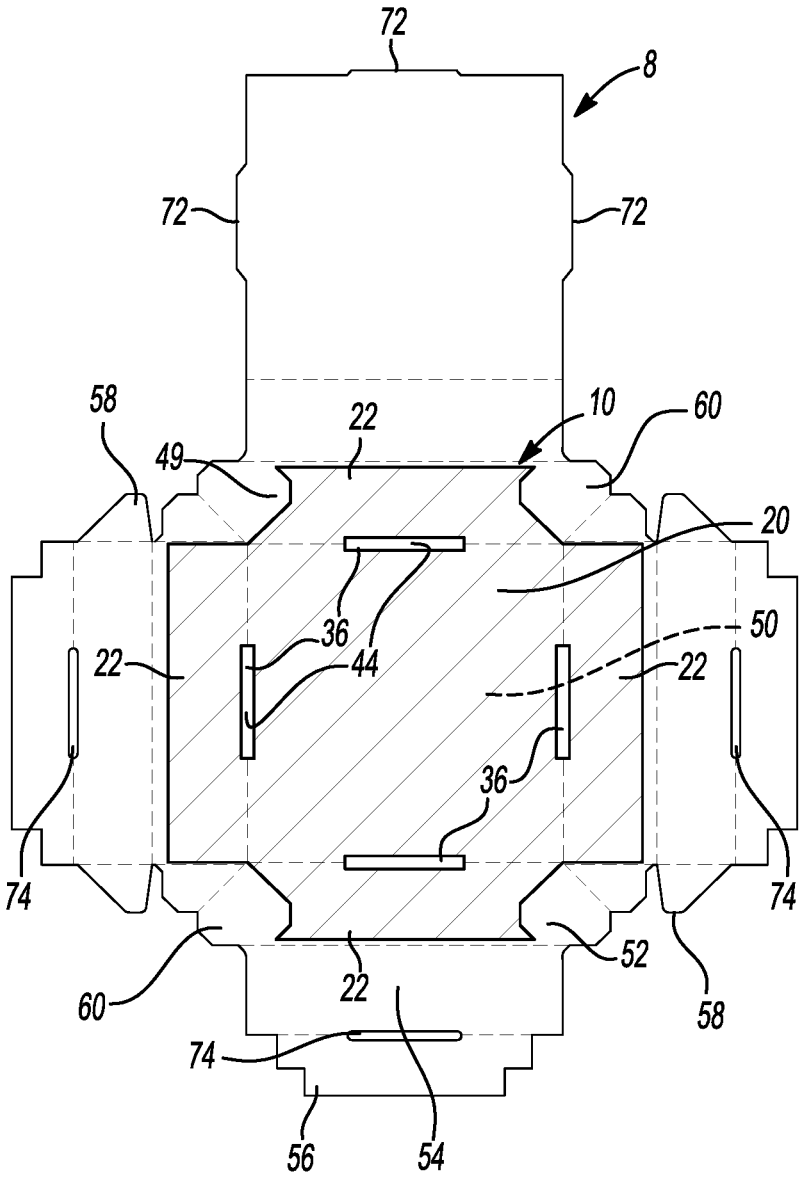

FIG. 9 is a view of FIG. 8 where regions have been shaded in so that the cover component and the tray insert component can be more easily distinguished.

Figure 10:
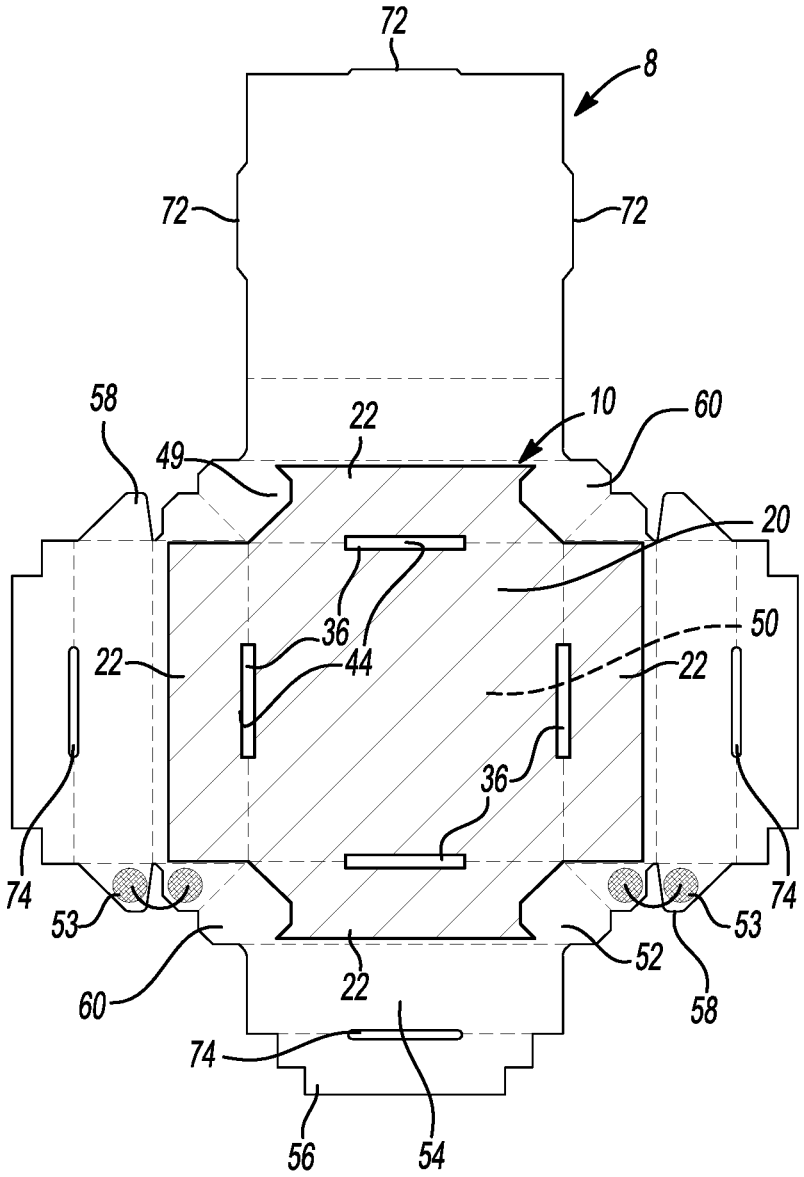
FIG. 10 is the top view of FIG. 9, illustrating locations for attaching one or more cover flaps to a webbing, such as with an adhesive, tape, or fastener.

FIG. 10 illustrates the components of FIG. 8 illustrating a location for securing a lateral tab 58 of the cover 8 to the webbing 60 of the cover 8. By folding one or more (e.g., two non-adjacent or two opposing) second cover flap 54 over a first cover flap 52, the cover 8 can be secured in a generally flat configuration (e.g., using an adhesive, tape or fastener).

Figure 11:
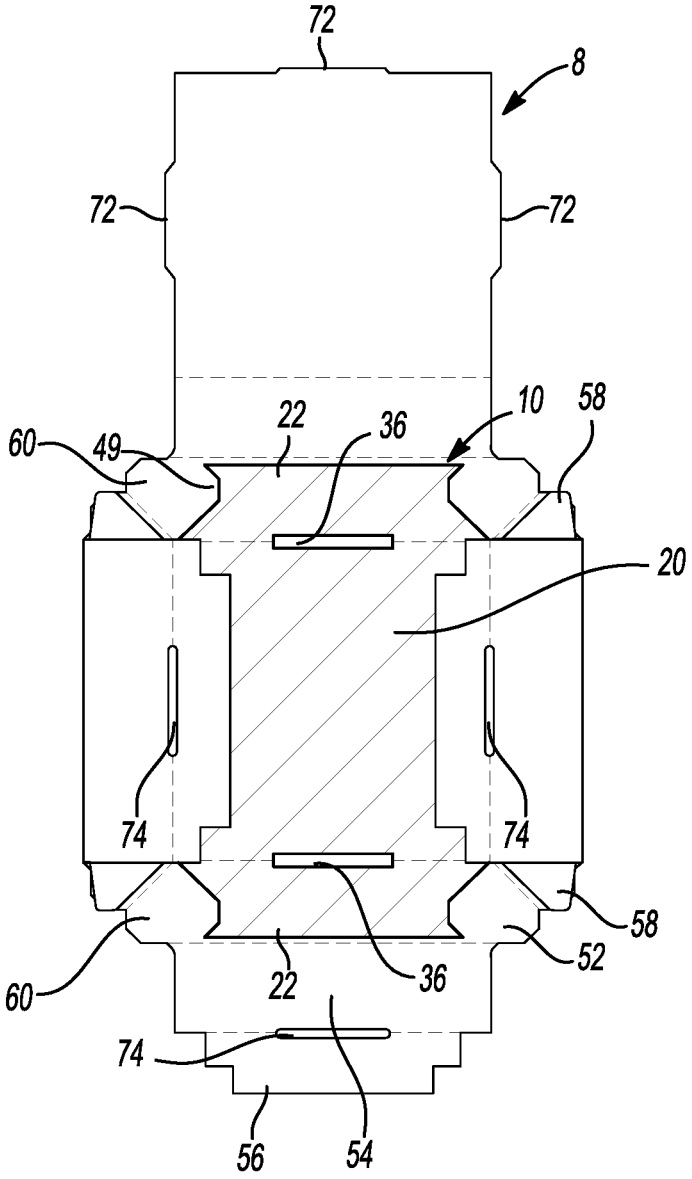
FIG. 11 is an illustrative kit showing the components of FIG. 10, with one or more cover flaps secured to a webbing.

FIG. 11 illustrates the components of FIG. 10, where two opposing second cover flaps 54 have been folded over a first cover flap. The folded portions may optionally be secured with an adhesive, tape or fastener. Here, two of the third cover flaps 56 rest on the floor 26 of the insert base 20 and two of the slots in the cover 8 are positioned for receiving floor securing protrusions 72 from side edges of the floor cover section 70.

FIG. 12 is an illustrative assembled tray including a tray insert 8, a cover 10, and a neck component 6. As shown in FIG. 13, the cover may have a graphic and/or text 82 on a show surface 80 of the cover 8, on a show surface 80 of the neck component 6, or both. After assembling the tray insert 10 and cover 8, the assembled neck component 6 may be slid into the opening of the covered tray insert 8, 10. The floor securing protrusion 72 from the neck component 6, may engage one or more of the floor cover securing features of the cover 8 and/or tray insert 10 so that the neck component 6 is secured to the other components 8, 10. The neck component preferably includes a floor cover portion 70 that is sufficiently large (e.g., having the same general length and width) for covering the floor 26 of the tray insert 10.

FIG. 13 is an illustrative assembled tray including a tray insert, and a cover having an integrated floor cover portion 70. As shown in FIG. 13, the floor cover portion may substantially or even entirely cover the floor 26 of the tray insert 10. The floor cover portion may have a show surface 80 that includes a text and/or a graphic 82.

Figure 14A:
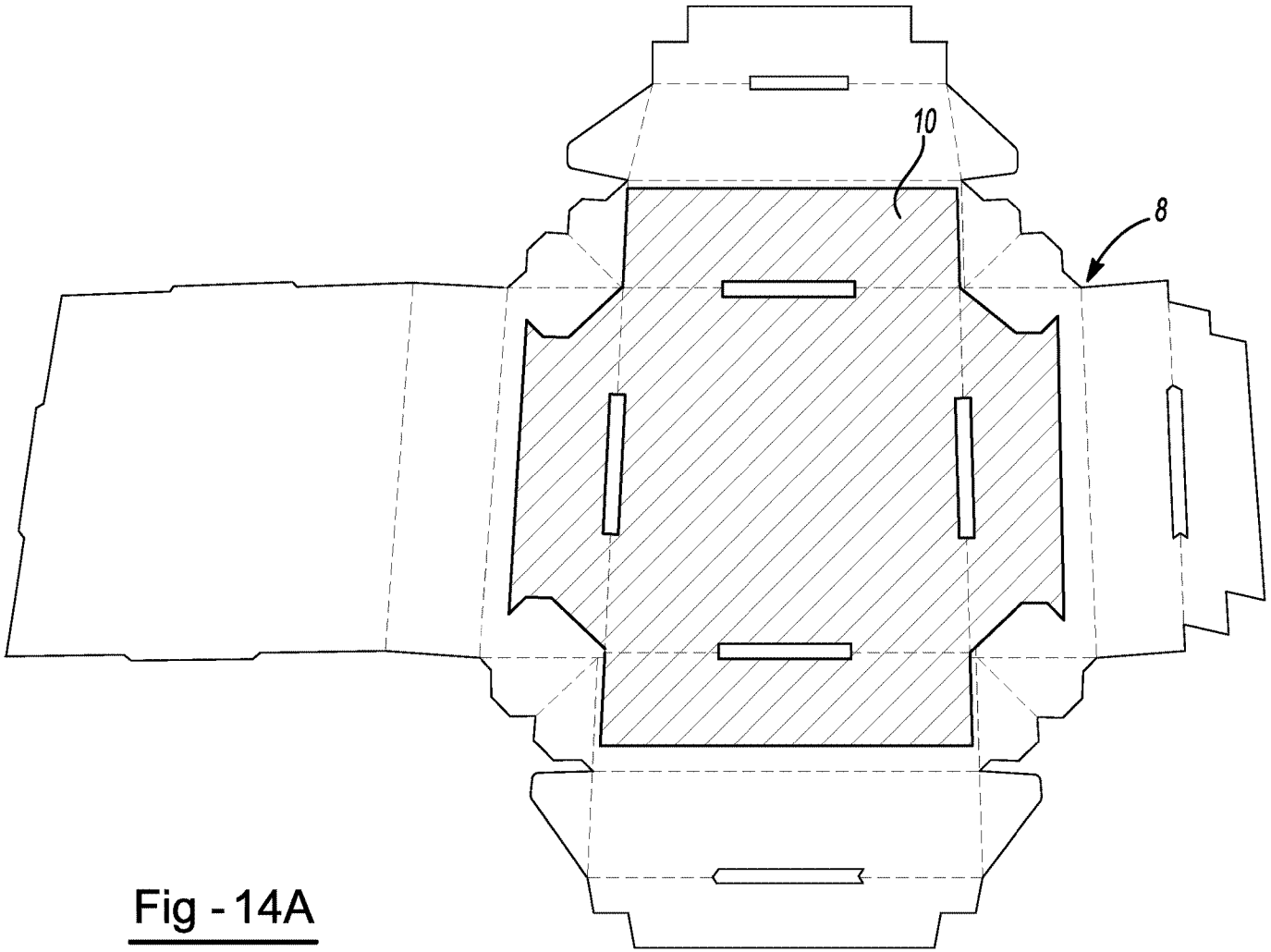
FIGS. 14A, 14B, 14C, 14D, 14E, 14F, 14G are illustrative steps that may be employed in assembling a tray including a tray insert and cover having a floor cover portion. Any of these steps may independently be performed mechanically or manually.

FIGS. 14A, 14B, 14C, 14D, 14E, 14F, 14G are illustrative steps that may be employed in assembling a tray 2 having multiple components including a tray insert 10 and a cover 8 having a floor cover portion 70. Any of these steps may independently be performed mechanically or manually. It will be appreciated that some steps may be eliminated, replaced with alternative steps, or be combined. With reference to FIG. 14A, the process may include a step of arranging a tray insert 10 over a cover 8, so that the insert base 20 is generally aligned with the cover base 50. Preferably, the tray insert 10 is arranged so that the first insert flaps are generally positioned over the first cover flaps 52. It will be appreciated that the tray insert 10 may be arranged (e.g., by folding the flaps) into a generally tray-like configuration prior to, or after positioning the tray insert 10 relative to the cover 8. For example, a folded tray insert 10 may be position over a cover 8 so that only the insert base 20 contacts the cover base 50.

Figure 14B:
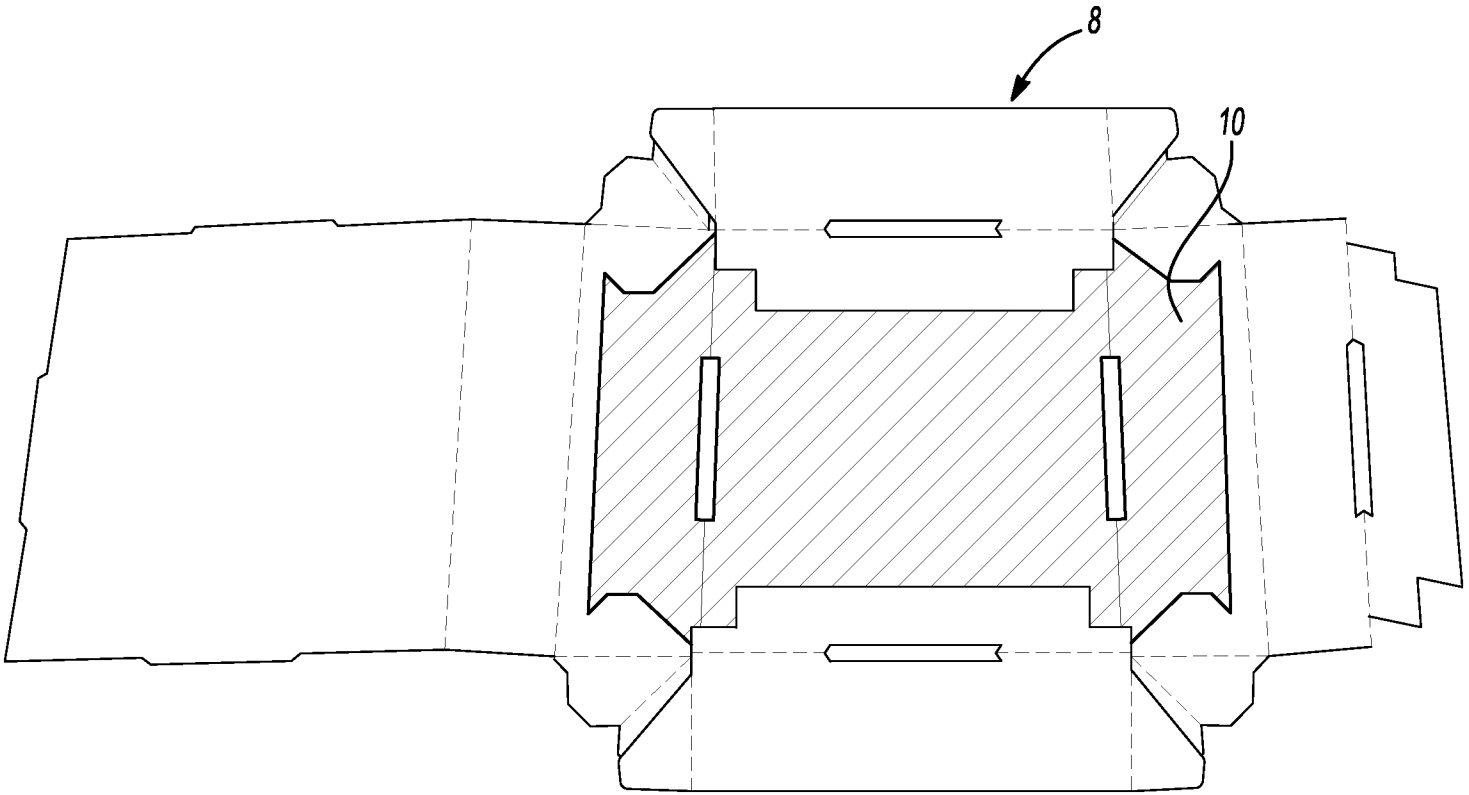
Figure 14C:
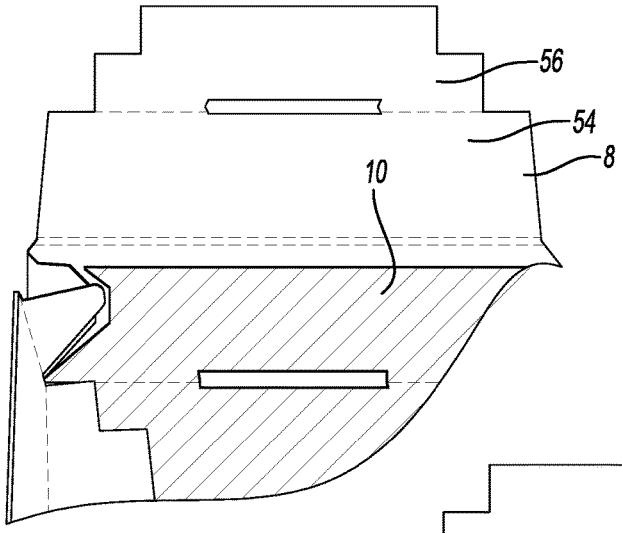
Figure 14D:
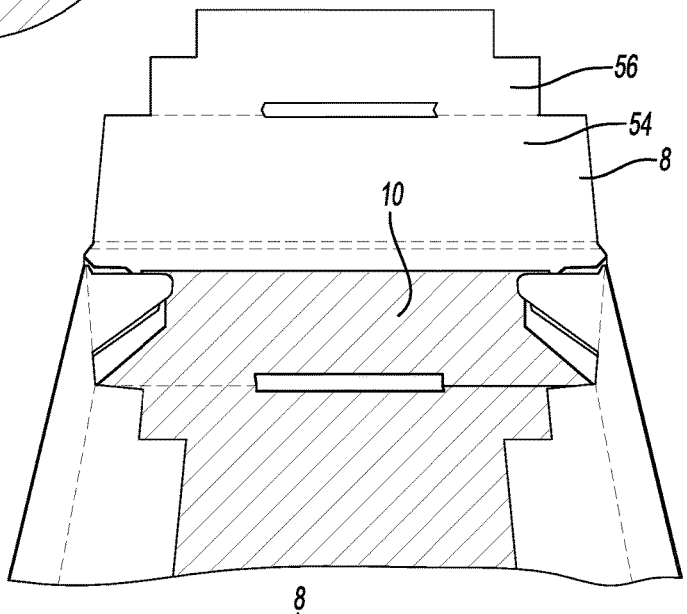
Figure 14E:
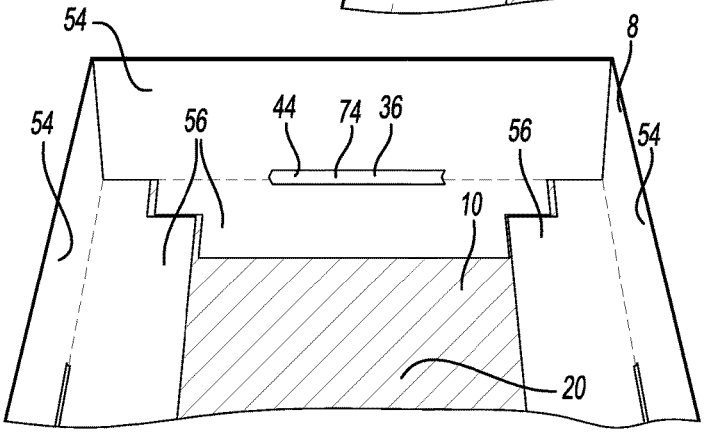
Figure 14F:
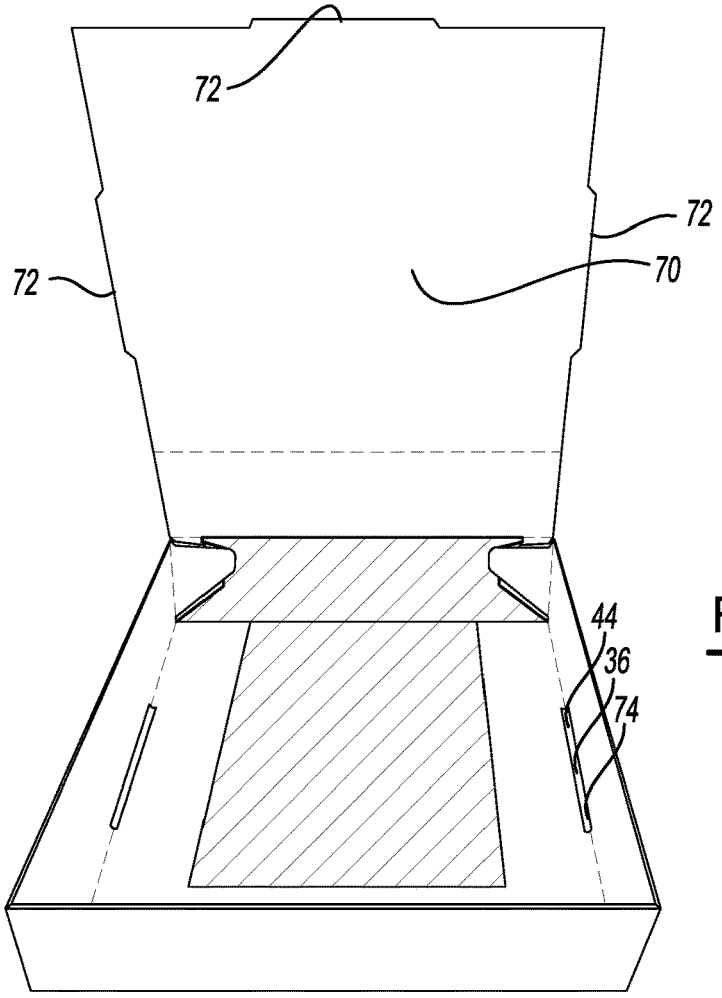
Figure 14G:
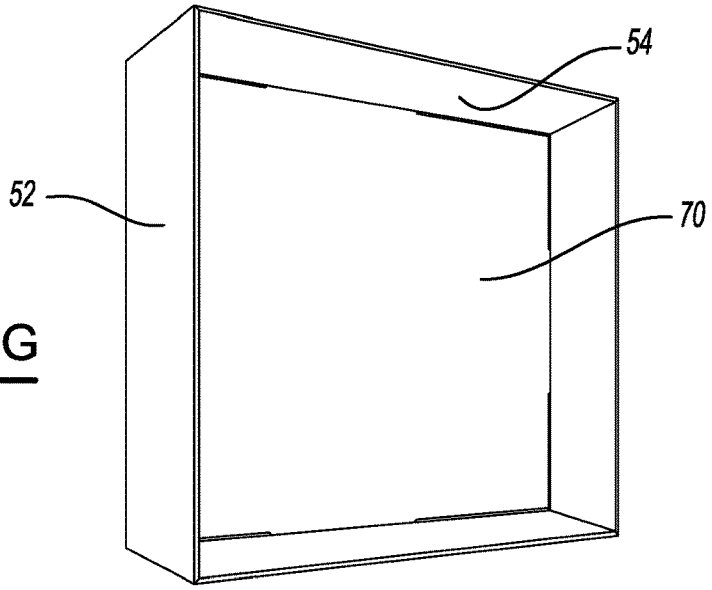

With reference to FIG. 14B, the process may include a step of folding one or more of the second cover flaps 54 (relative to the first cover flaps 52) so that they cover the inner side walls of the tray insert. As illustrated in FIG. 14B, two opposing second cover flaps 54 may be folded first. The process may include a step of folding one or more of the first cover flaps (relative to the cover base 50) and/or one or more of the first insert flaps 30 (relative to the insert base 20) so that the first cover flaps and/or the first insert flaps 30 are in a generally upright position. It will be appreciated that a first cover flap may be folded at the same time as a first insert flap, or the first insert flap may be folded first. The process may include a step of folding a webbing 60 (e.g., along a crease line of the webbing), such as illustrated in FIG. 14C. Preferably the webbing becomes located on the interior of the tray, the webbing becomes hidden in a insert cut-out 49, or both. The process may include a step of folding a third cover flap 56 so that it contacts a portion of the floor 26 of the tray insert 10. With reference to FIG. 14D, two or more third cover flaps 56 may be fully positioned before folding the remaining second cover flaps relative to their first cover flaps. The process may include a step of folding all of the first, second and third cover flaps 52, 54, 56 over the insert and contacting the third cover flaps to the floor 26 of the tray insert 10 prior with the exception of the side that includes the integrated floor cover portion 70. As illustrated in FIG. 14E, at an intermediate stage, all external surfaces of the tray insert 10 may be covered except for portions of the floor 26 of the tray insert and one side wall 24. At this point, the cover 8 may be positioned with all of the third cover flaps generally flush with the floor 26 of the tray insert, with the floor cover securing features 74 positioned for receiving the floor securing protrusions 72 from the floor cover section 70, or both, such as illustrated in FIG. 14F. As illustrated in FIG. 14F, the folded webbing 60 may partially or entirely fit into the space of an insert cut-out 49. The process may include one or more steps of folding the floor cover portion 70 (relative to the second cover flap), folding the second cover flap relative to the first cover flap 52, or both, so that the remaining (uncovered) surfaces of the tray insert are covered. The process may include a step of engaging one or more floor securing protrusions 72 from the edges of the floor cover section 70 with the floor cover securing features (e.g., slots) 44, 74 such as the slots 74 in the cover as shown in FIG. 14G, so that the cover 8 remains securely attached around the tray insert 10.

Figure 15:
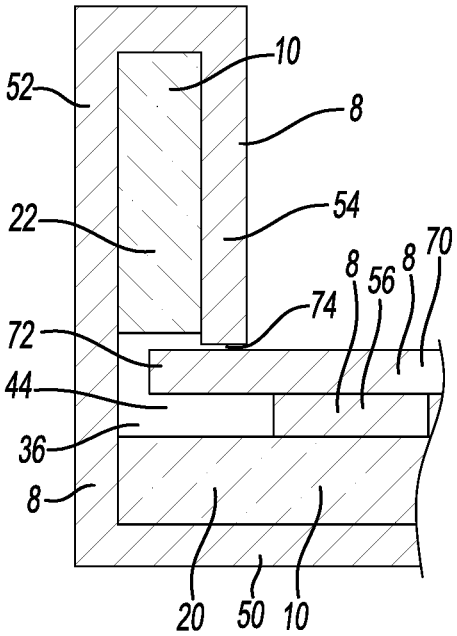
FIG. 15 is a cross-section of an illustrative tray including a tray insert and a cover.

FIG. 15 is a cross-section of a portion of an illustrative tray 2 according to the teachings herein. The tray may include one or more features illustrated in the cross-section of FIG. 15. The tray may include a cover 8 having a slot 74 and a tray insert 10 having a corresponding slot 36. A floor cover portion 70 may include a protrusion 72 that is sufficiently long for sliding the protrusion through the slot 74 of the cover 8 and partially into the slot 36 of the tray insert 10, so that the floor covering portion 70 is secured in place. It will be appreciated that a plurality of these floor securing features and protrusions may be required. The protrusion 72 from the floor cover portion 70 preferably does not penetrate past the insert 10. As such, the length of the protrusion 72 is preferably less than the combined thickness of one layer of the tray insert 10 and one layer of the cover 8. The cross-section of FIG. 15 may be obtained by covering the insert illustrated in FIG. 6 with the cover illustrated in FIG. 7.

Figure 16A:
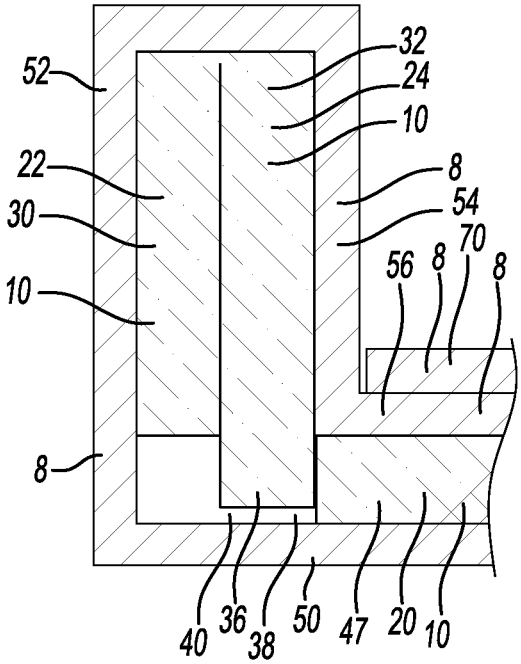
FIG. 16A is a cross-section of an illustrative tray including a tray insert and a cover. An upright wall of the tray may include two layers of the tray insert folded over. The upright wall may be secured in place by inserting a protrusion into a slot.

The tray may include one or more features illustrated in the cross-section of FIG. 16A. FIG. 16A is an illustrative cross-section of a portion of a tray 2 including a tray insert 10 and a cover 8. The tray may include one or more features illustrated in the cross-section of FIG. 16A. The tray 2 may have an upright wall that includes two layers of the tray inert 10. For example, the tray 2 may include an outer wall 22 that is formed from by folding (e.g., a 90° fold) a first insert flap 30 into a generally vertical orientation relative to an insert base 20 having a generally horizontal orientation. An inner wall 24 may be formed by folding a distal insert flap 32 (e.g., a 180° fold) relative to the first inert flap 30. For example, the distal insert flap 32 may be folded so that it contacts a surface of the first insert flap 30. The distal insert flap 32 may include a protrusion 38 capable of being inserted into a slot 36. Preferably, the protrusion 38 is positioned and sufficiently long so that it secures the distal insert flap 32 in an upright position. The insert base 20 preferably includes a flexible locking portion 47 capable of flexing. The flexible locking portion 47 may be capable of sufficiently flexing so that the protrusion 38 can be easily inserted into the slot 36. The flexible locking portion 47 may be capable of contacting the protrusion 38. Preferably, the flexible locking portion 47 applies a sufficient force onto the protrusion 38 so that the protrusion remains in place. The length of the protrusion 38 preferably is less than the thickness of the tray insert 10 (e.g., the thickness of the insert base 20). A tray 2 having the cross-section of FIG. 16A may be obtained by wrapping a tray insert 10, such as the tray insert illustrated in FIG. 1, with a cover, such as the cover illustrated in FIG. 2.

Figure 16B:
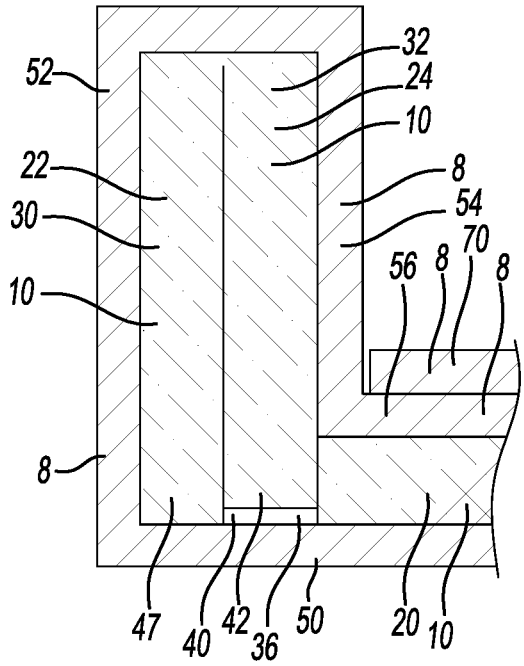
FIG. 16B is a cross-section of an illustrative tray including a tray insert and a cover. An upright wall of the tray may include two layers of the tray insert including a distal insert flap that forms an outside wall and an a lateral insert flap that folds in front of the distal insert flap to form an inside wall. The lateral insert flap may be secured in place by inserting a protrusion from the lateral insert flap into a slot.

FIG. 16B is an illustrative cross-section of a portion of a tray 2 including a tray insert 10 and a cover 8. The tray may include one or more features illustrated in the cross-section of FIG. 16B. The tray 2 may have an upright wall that includes two layers of the tray inert 10. For example, the tray 2 may include an outer wall 22 that is formed from by folding (e.g., a 90° fold) a first insert flap 30 into a generally vertical orientation relative to an insert base 20 having a generally horizontal orientation. An inner wall 24 may be formed by folding one or more lateral insert flaps 34 in front of the outer wall. For example, a lateral insert flap 34 may be folded so that it contacts a surface of the first insert flap 30. The lateral insert flap 34 may include a protrusion 38 capable of being inserted into a slot 36 suitable (e.g., for securing the lateral insert flap in an upright position). The outer wall 22 preferably includes a flexible locking portion 47 capable of flexing. The flexible locking portion 47 may be capable of sufficiently flexing so that the protrusion 38 can be easily inserted into the slot 36. The flexible locking portion 47 may be capable of contacting the protrusion 38. Preferably, the flexible locking portion 47 applies a sufficient force onto the protrusion 38 so that the protrusion remains in place. A tray 2 having the cross-section of FIG. 16B may be obtained by wrapping a tray insert 10, such as the tray insert illustrated in FIG. 1, with a cover, such as the cover illustrated in FIG. 2.

Figure 16C:
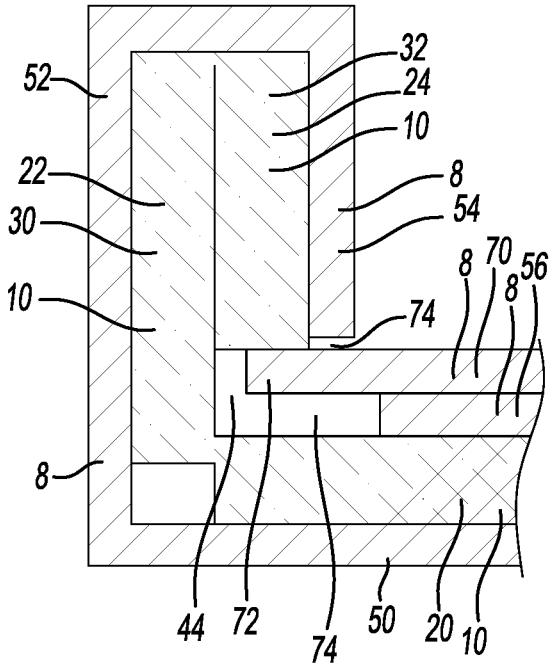
FIG. 16C is a cross-section of an illustrative tray including a tray insert and a cover.

FIG. 16C is an illustrative cross-section of a portion of a tray 2 including a tray insert 10 and a cover 8. The tray may include one or more features illustrated in the cross-section of FIG. 16C. The tray 2 may have an upright wall that includes two layers of the tray inert 10, including an inner wall 24 and an outer wall 22. The inner wall may include a floor cover securing feature 44. When the inner wall is positioned in an upright position, the floor cover securing feature 44 may become an opening (e.g., an opening in the region where the inner wall 24 meets the insert base 20 at the location of the floor cover securing feature). The cover 8 may have a slot 74 that corresponds with the floor cover securing feature 44. A floor cover portion 70 may include a protrusion 72 that is sufficiently long for sliding the protrusion through the slot 74 of the cover 8 and partially into the floor cover securing feature 44 of the insert 10. so that the floor covering portion 70 is secured in place. It will be appreciated that a plurality of these floor securing features and protrusions may be required. The protrusion 72 from the floor cover portion 70 preferably does not penetrate past the insert 10. As such, the length of the protrusion 72 is preferably less than the combined thickness of one layer of the tray insert 10 and one layer of the cover 8. The cross-section of FIG. 16C may be obtained by covering the insert illustrated in FIG. 1 with the cover illustrated in FIG. 2.

Figure 17:
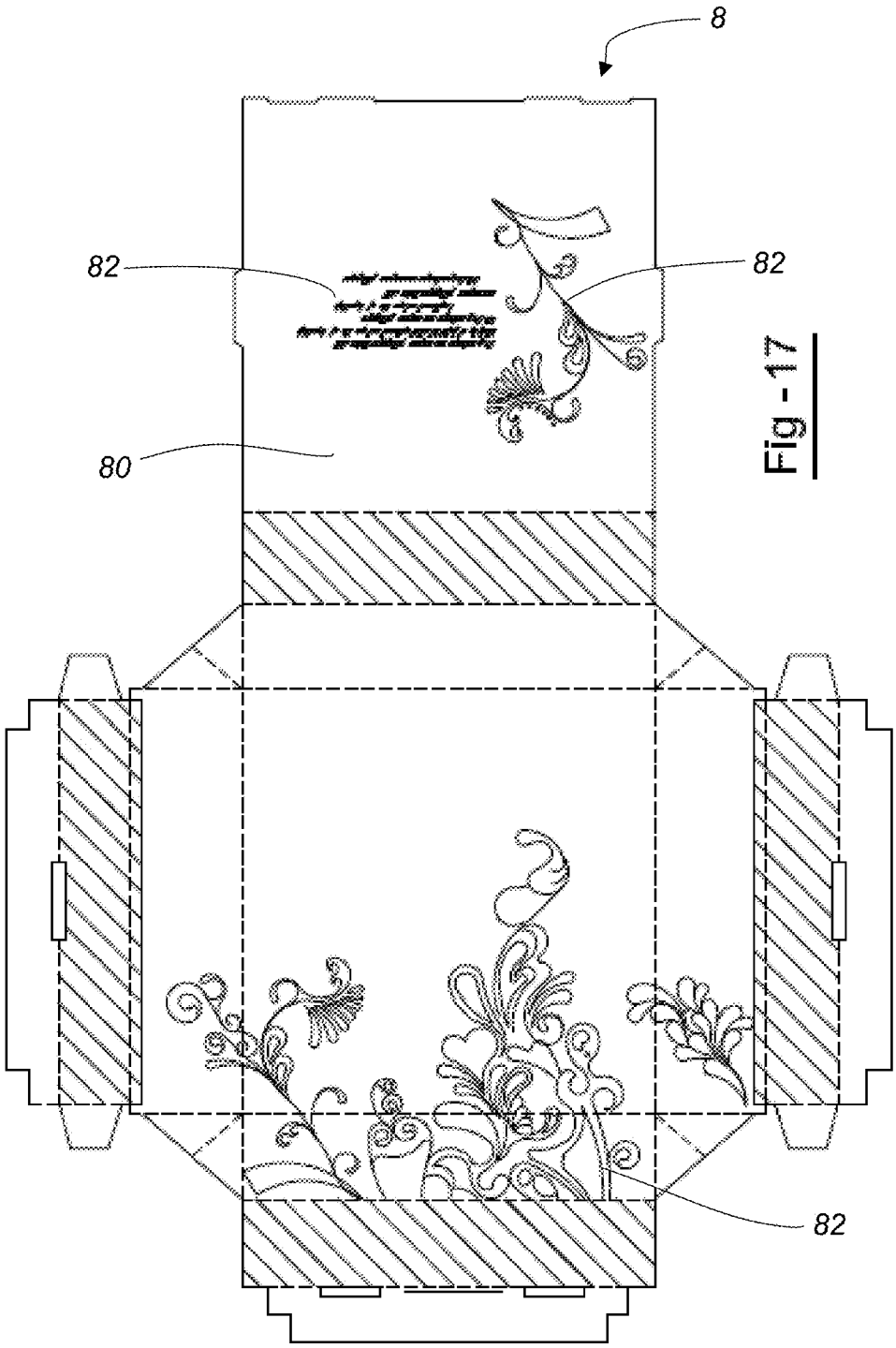
FIG. 17 is a photograph of an illustrative cover.

FIG. 17 is a photograph of an illustrative cover according to the teachings herein. The photograph shows a show surface 80 of the cover 8, including graphics 82 that will cover multiple sides of the tray 2. This cover includes features from the cover shown in FIG. 2.

Figure 18:
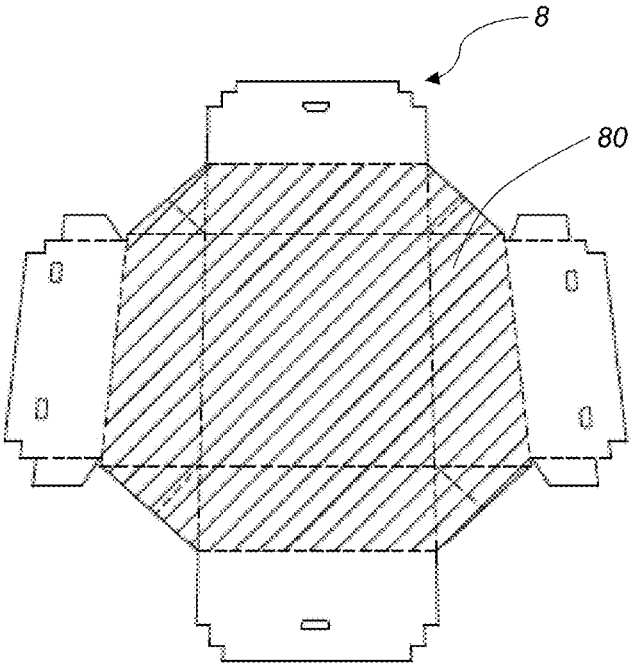
FIG. 18 is a photograph of an illustrative cover.

FIG. 18 is a photograph of an illustrative cover according to the teachings herein. The photograph shows a show surface 80 of the cover 8, including graphics 82 that will cover multiple sides of the tray 2. This cover includes features from the cover shown in FIG. 4.

Figure 19:
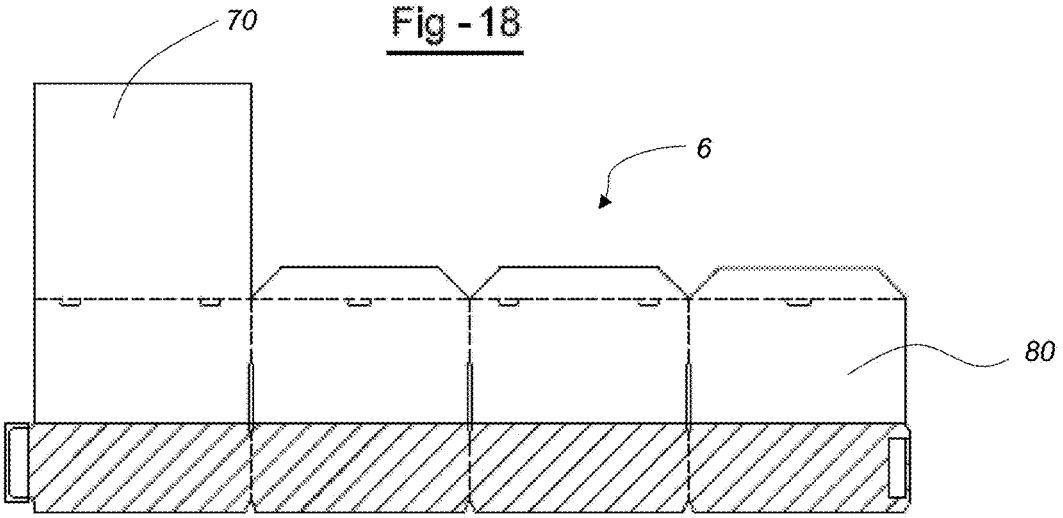
FIG. 19 is a photograph of an illustrative neck including floor covering portion.

FIG. 19 is a photograph of an illustrative neck component including a floor covering portion 70. The photograph shows a show surface 80 of the cover 6, including graphics 82 that will cover multiple sides of the tray 2. This neck component includes features from the neck component shown in FIG. 5. When using a neck component 6 having a floor covering portion 70, it may be possible to employ a cover component 8 that does not include a floor covering portion 70, such as the cover component 8 illustrated in FIG. 18.

Figure 20:
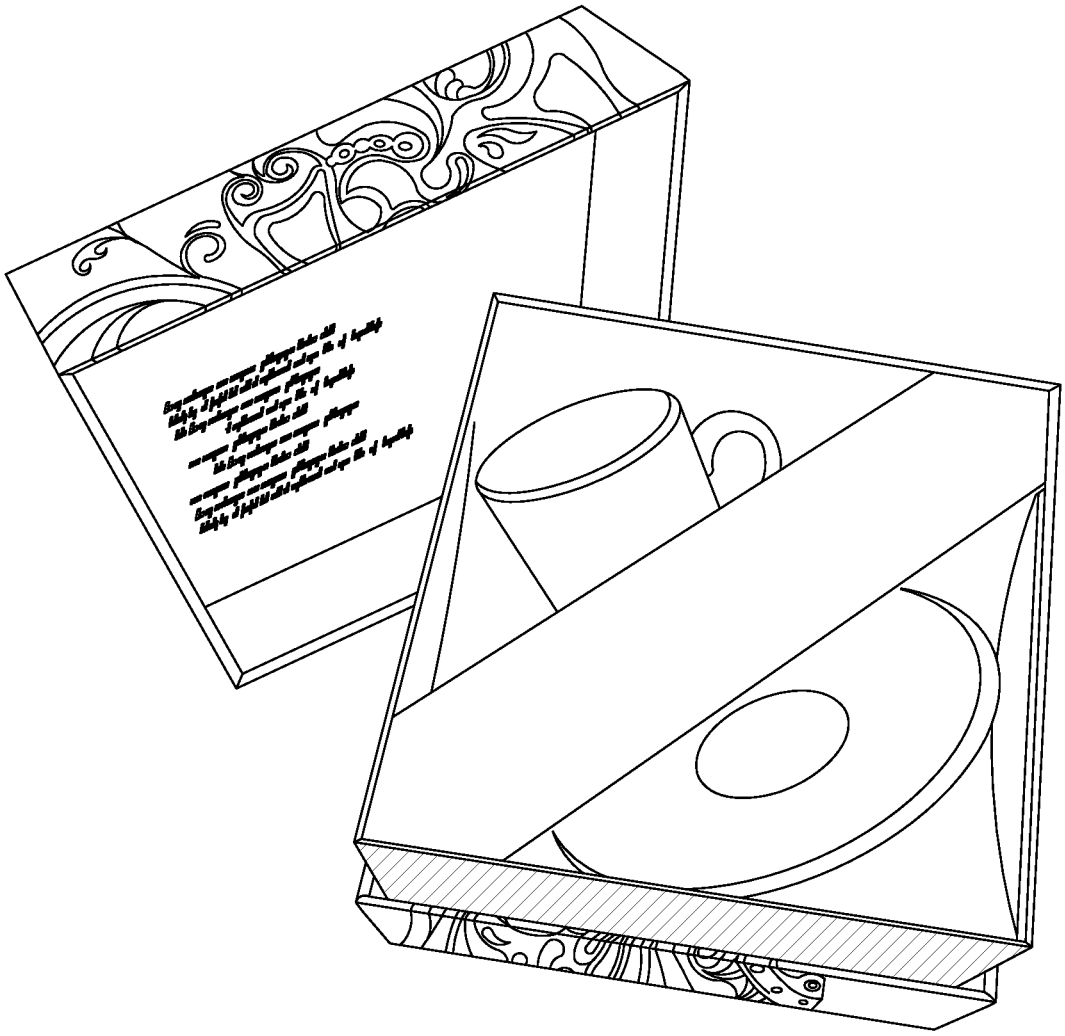
FIG. 20 is a photograph of an illustrative box including a box compartment comprising a first tray according to the teachings herein, a box lid comprising a second tray according to the teachings herein, or both.

FIG. 20 is a photograph of an illustrative box that includes a box compartment comprising a first tray according to the teachings herein, a box lid comprising a second tray according to the teachings herein, or both.

Two or more components for a tray may be provided as a kit. Such a kit may include an tray insert, a cover, a neck component, or any combination thereof. Preferred kits include a tray insert and a cover. The components in the kit may be provided as generally flat blanks or may provided with one or more folds. Preferred kits are sufficiently flat (e.g., each component may be substantially entirely flat), so that multiple components, multiple kits, or both, can easily and efficiently be stacked and/or transported. A kit may include a stack of components including a plurality of tray inserts, a plurality of covers, or both. A kit may include a sufficient number of components for assembling a box including a box compartment and a box lid, where the box compartment, the box lid, or both are formed of a tray according to the teachings herein including an tray insert and a cover.

The components of a tray may be provided separately or as a kit including one or more (e.g., all) of the components. For example, the kit may include a tray insert and a cover component having an integrated floor cover portion. As another example, the kit may include a tray insert, a cover component, and a neck component having a floor cover portion. As another example, the kit may include a tray insert, a cove component, and a separate component including or consisting essentially of a floor cover portion. The components in the kit may be unassembled or partially assembled. The components in the kit may be provided in a generally flat arrangement. However, it will be appreciated that one or more components (e.g., a tray insert) may be provided in an arrangement having one or more upright side walls.

A particularly preferred kit includes a tray insert and a cover wherein the cover and tray component have been partially assembled with one or more folds, yet both components remain in a generally flat arrangement. Preferably such a kit is sufficiently assembled (e.g., by folding of the components) so that the tray insert remains in position (e.g., by at least a frictional fit). In the partially assembled cover, one or more portions of the cover may be secured in a folded position (e.g., using an adhesive, tape, or fastener). By way of example, such a partially assembled kti may be prepared using a cover 8 that includes a plurality of tabs extending laterally from two second cover flaps, wherein two second cover flaps are connected to first cover flaps and the two first cover flaps are connected to another first cover flap by two sets of webbings. Such a cover component may be folded over along a crease line between the two second cover flaps and the first cover flaps to which they are connected so that the two webbings contact different tabs. The webbings can be secured to the tabs. Once secured, the two second cover flaps remain in a folded configuration that allows for positioning of a tray insert and or allows for maintaining the positioning of a tray insert so that the cover base is aligned with a base of the insert. It will be appreciated that a kit may be provided with a tray insert pre-positioned in the folded cover.

With reference to FIG. 10, an adhesive, tape or fastener may be employed to secure one or more side tabs to another portion of the cover, such as a webbing region. When the second cover flap is folded over the first cover flap, the adhesive, tape or fastener secures the cover in the folded position, as illustrated in FIG. 11. Preferably, two side tabs on opposing second cover flaps are both secured to another portion of the cover. As seen in FIGS. 10 and 11, after the cover portion has been secured in two locations, it may still be possible to slide the tray insert into and/or out of the folded cover. It will be appreciated that a kit having features of FIGS. 11 may be provided in a generally flat arrangement. Such a kit would eliminate the need to properly position the components and thus reduce or eliminate assembly errors and/or reduce assembly time.

The trays may be used individually or may be combined with one or more other parts. For example two trays may be assembled into a box. Such a box may consist of the two trays, or may include additional parts. Such a box may include a first tray that acts as a box compartment and a second tray that functions as a box lid. It will be appreciated that a tray according to the teachings herein may be employed for a box compartment, for a box lid, or both. The upright walls of the box lid preferably have a height that is the same or less than the height of the upright walls of the box compartment.

Additionally, it is contemplated that the components may be provided as a box kit including a tray insert and a cover for a box compartment, and a tray insert and a cover for a box lid. The covers for the box compartment and the box lid may be coordinated. For example, the covers may include a text or graphic that continues from the box compartment to the box lid.

After forming a tray, it may be desirable to cover a portion (or even all) of the floor portion of the tray with a floor overlayer. Such a floor overlayer may provide a protective layer, one or more graphics, one or more colorings, one or more texts (such as a description, instructions, a product name, a slogan, and the like), or any combination thereof. The floor overlay may be secured to the tray using any convenient means. When used with a tray according to the teachings herein, the securing of the floor overlayer may be easily achieved using slots from the tray insert, slots from the cover, or both. For example the floor overlayer may include a sufficient number of protrusions or other components sufficient for engaging with the slots so that the floor overlayer remains in a secured position relative to the floor portion of the tray.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the Invention of a range in terms of at "'x' parts by weight of the resulting polymeric blend composition" also contemplates a teaching of ranges of same recited amount of "x" in percent by weight of the resulting polymeric blend composition."

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. By use of the term "may" herein, it is intended that any described attributes that "may" be included are optional.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

What is claimed is:

1. A tray including a tray insert and a cover for wrapping the tray insert;

wherein the cover comprises:

a cover component including:

a cover base having a generally polygonal shape with three or more side edges;

a plurality of first cover flaps, each connected to a different side edge of the cover base;

a plurality of second cover flaps, each connected to a different first cover flap and each having one or more cover slots;

a plurality of third cover flaps, each connected to a second cover flap; and a floor cover portion connected to one of the second cover flaps, wherein the floor cover portion includes a floor cover base having a polygonal shape with three or more side edges, wherein the polygonal shape of the floor cover portion is generally the same shape as the polygonal shape of the cover base; and wherein one side edge of the floor cover portion is connected to one of the second cover flaps and the other side edges are each connected to one or more protrusions arranged for inserting into a corresponding cover slot of the second cover flaps;

wherein the tray insert includes a tray base having opposing bottom surface and floor surface, and a plurality of upright side walls each having opposing inward facing surface and outward facing surface, wherein each upright sidewall includes one or more insert slots, each capable of receiving one of the protrusions, wherein the total number of insert slots is greater than the number of protrusions;

wherein the insert base and the cover base have the same polygonal shape.

2. The cover of claim 1, wherein the cover slots have an elongated shape with an aspect ratio of about 2; and the cover slots are located on the second cover flap near the third cover flap or extends between the second cover flap and the third cover flap.

3. The tray of claim 1, wherein the tray cover is capable of covering the tray insert, i) the cover base is sufficiently large for covering the bottom surface of the tray insert, ii) the first cover flaps are sufficiently large for covering the outward facing surfaces of the tray insert, iii) the second cover flaps are sufficiently large for covering the inward facing surfaces of the tray insert, and iv) the floor portion is sufficiently large for covering the floor surface of the tray insert.

4. The tray of claim 3, wherein the third cover flaps are shaped for forming a border having a generally uniform width over the cover base when the cover base is folded between the first and second cover flaps so that the third cover flaps overlay a portion of the cover base.

5. The tray of claim 4, wherein one of the second cover flaps includes two or more cover slots.

6. The tray of claim 1, wherein the protrusions each have a length and the cover slots each have a length sufficient for receiving the length of a corresponding protrusion, wherein the number and length of the protrusions and the number of cover slots are sufficient for (i) securing the floor cover portion to (i) the tray insert and (ii) the second cover flaps without the use of adhesive, tape, or other bonding means for securing the floor cover portion in place.

7. The tray of claim 6, wherein one of the second cover flaps includes two or more cover slots.

8. The tray of claim 7, wherein one of the upright side walls includes two or more insert slots.

9. The tray of claim 1, wherein the cover is free of any tabs connected to a side edge of the third cover flap for inserting through a slot in the tray insert; the insert cover is free of any slots for receiving a tab connected to the third cover flap of the cover; or both.

10. The tray of claim 1, wherein the tray insert includes a first insert flap connected to a side of the insert base, wherein the first insert flap is capable of folding to an upright position for forming a side wall of the tray; wherein the number of first insert flaps of the tray insert is four, and wherein each first insert flap is connected to a different side edge of the insert base.

11. The tray of claim 10, wherein the tray insert includes one or more reinforcement insert flaps each capable of being folded so that it faces a first insert flap and reinforces a side wall of the tray, wherein each reinforcement insert flap is connected to one or more reinforcement insert flaps and/or one of the first insert flaps.

12. The tray of claim 10, wherein the tray insert includes one or more reinforcement insert flaps capable of being folded so that it faces a first insert flap and reinforces a side wall of the tray, and the tray insert includes one or more wall anchoring protrusions connected to a reinforcement insert flap, and one or more wall anchoring slots in the insert base, wherein the wall anchoring protrusion is positioned and shaped for sliding into a wall anchoring slot.

13. The tray of claim 10, wherein the tray insert includes slits for forming a flexible locking portion in a region of a first insert flap adjacent to an wall anchoring slot, wherein the flexible locking portion is positioned and configured so that it can flex away from the insert base for allowing easy entry of an wall anchoring protrusion into the anchoring slot and/or so that it can provide a force towards the insert base for at least partially securing the wall anchoring protrusion in place.

14. The tray of claim 1, wherein the tray insert includes slits for forming a flexible locking portion in a region of an insert base adjacent to an anchoring slot, wherein the flexible locking portion is positioned and configured so that it can flex relative to the insert base for allowing easy entry of an wall anchoring protrusion into an anchoring slot and/or so that it can provide a force outwards from the insert base for at least partially securing the wall anchoring protrusion in place.

15. The tray of claim 10, wherein the insert base includes a sufficient number of slits so that the insert base can be flexed while assembling the tray without cracking the insert base.

16. A tray including a tray insert and a cover for wrapping the tray insert;

wherein the cover comprises:

a cover component including:

a cover base having a generally polygonal shape with three or more side edges;

a plurality of first cover flaps, each connected to a different side edge of the cover base;

a plurality of second cover flaps, each connected to a different first cover flap;

a plurality of third cover flaps, each connected to a second cover flap;

a plurality of webbings connecting adjacent first cover flaps; and a floor cover portion connected to one of the second cover flaps, wherein the floor cover portion includes a floor cover base having a polygonal shape with three or more side edges, wherein the polygonal shape of the floor cover portion is generally the same shape as the polygonal shape of the cover base; and wherein the tray insert includes a tray base having opposing bottom surface and floor surface, and a plurality of upright side walls each having opposing inward facing surface and outward facing surface, wherein the insert base and the cover base have the same polygonal shape; and wherein each of the webbings of the cover is positioned in a corresponding cut-out of the upright side walls of the tray insert so that the first and second cover flaps rest generally flat without any impressions from the extra material of the webbings, wherein each cut-out is sufficiently large for receiving one of the webbings and extends a thickness of the upright side wall of the tray insert.

17. The tray of claim 16, wherein the tray cover is sufficiently large for completely covering all of the surfaces of the tray insert.

* * * * *